US005501841A

United States Patent [19]

Lee et al.

[11] Patent Number: 5,501,841

[45] Date of Patent: Mar. 26, 1996

[54] CONNECTION-TYPE TREATMENT SYSTEM FOR MICRO SOLUTION AND METHOD OF TREATMENT

[75] Inventors: Yuan C. Lee, Timonium, Md.; Shinji Inoue, Los Altos, Calif.; Akinori Tsujimoto, Palo Alto, Calif.; Akimasa Miwa, Mountain View, Calif.

[73] Assignee: Artchem, Inc., Palo Alto, Calif.

[21] Appl. No.: 282,097

[22] Filed: Jul. 27, 1994

Related U.S. Application Data

[63] Continuation-in-part of Ser. No. 94,659, Jul. 20, 1993, abandoned, Ser. No. 136,711, Oct. 12, 1993, abandoned, and Ser. No. 6,783, Jan. 21, 1993, abandoned, which is a continuation-in-part of Ser. No. 930,017, Aug. 13, 1992, abandoned, which is a continuation-in-part of Ser. No. 791,837, Nov. 14, 1991, abandoned, said Ser. No. 94,659, is a continuation-in-part of Ser. No. 930,017, said Ser. No. 136,711, is a continuation of Ser. No. 930,017.

[51] Int. Cl.[6] ..... B01L 3/14

[52] U.S. Cl. ..... 422/101; 422/61; 422/103; 436/177; 435/287.9

[58] Field of Search ..... 430/177–178; 435/296, 311; 422/61, 101, 103

[56] References Cited

U.S. PATENT DOCUMENTS

| | | | |
|---|---|---|---|
| 938,279 | 10/1909 | Schultze | 422/101 |
| 3,488,768 | 1/1970 | Rigopulos | 210/23 |
| 3,701,434 | 10/1972 | Moore | 210/477 |
| 4,131,544 | 12/1978 | Elahi | 436/178 |
| 4,180,383 | 12/1979 | Johnson | 422/101 |
| 4,222,870 | 9/1980 | Sternberg et al. | 210/639 |
| 4,632,761 | 12/1986 | Bowers et al. | 210/650 |
| 4,675,110 | 6/1987 | Fay | 210/436 |
| 4,678,559 | 7/1987 | Szabados | 422/101 |
| 4,832,678 | 5/1989 | Sheeran | 494/16 |
| 4,832,850 | 5/1989 | Cais et al. | 422/101 |
| 4,948,564 | 8/1990 | Root et al. | 422/101 |
| 4,999,164 | 3/1991 | Puchinger et al. | 422/101 |
| 5,104,533 | 4/1992 | Szabados | 210/257.1 |

FOREIGN PATENT DOCUMENTS 7218833 3/1972 France .

*Primary Examiner*—Lyle A. Alexander

*Attorney, Agent, or Firm*—Jacques M. Dulin; Frederick J. Zustak

[57] ABSTRACT

A connection type fluid transfer and treatment system apparatus and method for efficiently and continuously executing transfer and treatment of small or micro amounts of sample solutions without substantial transfer loss, which includes a first microsolution reaction microtube having one open end and a second closed end, a second microsolution target microtube having substantially the same shape as the first microtube also having one open end and one closed end, and a connector for connecting together the open ends of the first microtube to the open end of the second tube. The connector includes a foramenous membrane support, which removably receives chemically or biologically treated membranes for applying a predetermined treatment to a solution while passing the sample solution from the first microtube to the second tube. Alternately, a "single use only" connector having disposed therein a membrane pretreated with a quantitative amount of reagent may be used for certain treatment operations. The single use only connector is used once and then discarded. An appropriate color indicator in the connector or membrane would serve to indicate whether the connector had been used. The sample is typically filtered through the membrane by centrifugation. The assembly also includes special adapters for receivingly engaging the dual tube/connector transfer system during centrifugation. The system permits handling microliter quantities of reactive solutions in biochemical analyses, treatments and assays without use of micropipets, without the usual loss of solution. An enzyme microsolution test kit system and method of use comprising one or more micro solution microtubes containing a predetermined quantity of a known, preferably lyophilized, reagent pre-coated on the microtube walls is disclosed.

40 Claims, 7 Drawing Sheets

CONNECTION-TYPE TREATMENT SYSTEM FOR MICRO SOLUTION AND METHOD OF TREATMENT

CROSS REFERENCE TO RELATED APPLICATIONS

This application is a continuation-in-part of three applications, all filed by one of us. The first application is Ser. No. 08/094,659, filed on Jul. 20, 1993, now abandoned for Connection Type Treatment System For Micro Solution And Method Of Treatment, which in turn is a C-I-P of Ser. No. 07/930,017 filed Aug. 13, 1992 now abandoned, of the same title, now abandoned, which in turn is a C-I-P of Ser. No. 07/791,837 filed Nov. 14, 1991 now abandoned, of the same title, now abandoned, the benefit of the filing dates of which we claimed under 35 U.S.C. §120.

This application is a C-I-P of a second application of the same inventor, Ser. No. 08/136,711, filed Oct. 12, 1993, for Connection Type Treatment System For Micro Solution And Method Of Treatment now abandoned, which is a file wrapper continuation of Ser. No. 07/930,017, filed Aug. 13, 1992, of the same title, now abandoned, which in turn is a C-I-P of Ser. No. 07/791,837 filed Nov. 14, 1991, of the same title, now abandoned, the benefit of the filing dates of which we claimed under 35 U.S.C. §120.

This application is a C-I-P of a third application of the same inventor, Ser. No. 08/006,783, filed Jan. 21, 1993, now abandoned, for biochemical Microanalysis System, which is a C-I-P of Ser. No. 07/930,017, filed Aug. 13, 1992, now abandoned, for Connection Type Treatment System For Micro Solution And Method Of Treatment, now abandoned, which in turn is a C-I-P of Ser. No. 07/791,837 filed Nov. 14, 1991, of the same title, now abandoned, the benefit of the filing dates of which we claimed under 35 U.S.C. §120.

FIELD OF THE INVENTION

The present invention relates to a connection-type micro solution transfer and treatment system apparatus and method of use for treatment of micro-quantities of solutions in biochemical and biomedical protocols. More particularly, this application relates to a connection-type micro-solution transfer and treatment system and method capable of performing efficient and continuous transfer and/or treatment of a small amount of sample solution, and to the use of micro-vials having coated on their interior walls predetermined quantities of chemical or biochemical agents which effect treatment of solutions deposited in the micro-vials, typically as a result of centrifugal filtration separation techniques using double micro-vial systems.

BACKGROUND

Conventionally, studies in the fields of analytical biochemistry and clinical chemistry have been generally made on the basis of working with sample treatment solutions of milliliter amounts. With recent development of biotechnology and immunochemistry, however, the studies in these fields are made on the basis of results of treatment of sample solutions of size on the order of microliters. This is because in many instances, only microliters of solution are available, or because so many different analyses must be undertaken that a larger original sample, on the order of 1–10 milliliters must be subdivided into a large number of aliquots, so that each aliquot is only a fraction of a milliliter. Further, in some instances, the biological target molecule of interest is present in such dilution that many repeated iterations of concentration or amplification must be undertaken before enough of the target sample is obtained for meaningful qualitative or quantitative analysis. The result of the concentration is, likewise, usually only a microliter quantity of solution for treatment after the subdivision into test aliquots, as many different tests, screenings or treatments must be effected to identify or characterize the target molecule. Working on a microscale has introduced a whole variety of new and extremely complex problems, particularly in the quantitative arena as the treatment unit of the sample solution becomes smaller.

In the analysis of biological samples by high performance liquid chromatography (HPLC), high performance capillary zone electrophoresis or many other techniques, pretreatment of a samples prior to analysis is often required. In other cases, two or more enzymatic digestions must be conducted in succession to obtain the desired products. In such instances, it is necessary for the sample solution, obtained by an enzyme reaction in a reaction tube, to be filtered through an ultrafiltration membrane to remove molecules having larger molecular weights or insoluble fine particles in order to prevent clogging of the high performance liquid chromatography columns.

For example, in a typical procedure for reducing oligosaccharides from a glycoprotein for analysis by high performance anion exchange chromatography (HPAEC) or high performance liquid chromatography (HPLC) after derivatization, the following steps are usually required: (1) reduction and alkylation; (2) dialysis; (3) freeze-drying; (4) digestion with a suitable protease; (5) gel filtration to enrich glycopeptides; (6) digestion with an enzyme to release oligosaccharides; and (7) separation of peptides and oligosaccharides to minimize interference. Between each of these steps a transfer of the sample solution is required.

Typically, an instrument, such as for example a micropipet, is used to transfer the sample solution from the reaction microtube into another device for ultrafiltration. In this method, however, a certain amount of loss of the sample is inevitable, for example when in the process of transferring the sample, solution is pipetted from one test microtube or vial to another, the quantity of solution which is left behind clinging to the pipette is so large that the quantitative analysis may be completely thrown off. The loss is greater when the sample quantities are smaller. In such treatments of micro-samples in microliters as described above, the effects of such a loss of sample cannot be neglected. Thus, new systems have been developed which are pipette-less to avoid the solution loss during transfer or analysis problems.

In a second example, a protein may be labeled using radioisotopes, and then the labeled protein constituent and the isotopes should be separated. In such cases, it is conventional that, after labeling with the isotope in a reaction tube, part or all of the sample solution is transferred, by micropiper or the like, into a device for radiation measurement. Accordingly, the above-described problem of loss of the sample also arises in the process of transferring the sample solution. Furthermore, the risk of radiation contamination of instruments used in liquid transfer cannot be avoided.

As described above, in the conventional handling method of sample solutions there exist problems of loss of sample and contamination of instruments. These problems cannot be avoided when transferring the sample solution from the reaction microtube into various kinds of solution treatment devices. Furthermore, when carrying out sample handling procedures which by their nature require a plurality of steps, such as the enzyme reaction and the sample radio-isotope labeling procedures described above, the problems associated with the amount of sample loss and degree of instrument contamination get progressively worse, since these sample handling procedures require multiple transfers of the sample.

A third problem lies in proper delivery of the quantitatively required amount of reagents of inorganic, organic and biochemical natures to the target solutions in order to effect the various treatment reactions to the target solutions. Again, the pipette effect is extremely significant. It is difficult to compensate for the pipette effect because the amount of solution which is left behind clinging to the pipette varies by the nature of the solvent and solute to some extent, and often to a greater extent by the technique of the person doing the laboratory manipulation. It is also inconsistent, because even the most experienced laboratory technician can have momentary lapses or interruptions which introduce irregularities.

In systems involving micro-filter centrifugation, the problem is also heightened because the solution left behind in one vial may have a very large effect. In addition, some of the reagents must be applied to the filter media between the two vials so that the reaction or treatment occurs as the filtrate liquid is passing through the membrane, and it is important that all of the liquid be treated. In other instances, the treatment must occur in connection with the liquid after filtration, because the filter must be used to retain non-treated or previously treated biological molecules, cells or other material.

U.S. Pat. No. 4,632,761 issued to Bowers et al., discloses a centrifugal microconcentrator assembly comprising a sample reservoir (source tube) and a filtrate cup (target tube) joined together at their openings by a connector assembly which contains a filter membrane for use in concentrating macromolecules from a sample solution. The connector assembly has a first end adapted for crimp sealing to the outer periphery of the reservoir opening and a second end adapted for plug insertion into the opening of the filtrate cup. In operation, the microconcentrater is placed in a centrifuge rotor with the filtrate cup (target tube) facing down, and is centrifuged such that the sample solution is transferred from the sample reservoir (source tube) through the filter membrane and into the filtrate cup (target tube). A disadvantage with this device occurs when repetitive filtration or treatment steps are desired, since the sample solution recovered in the filtrate cup (target tube) must be transferred somehow to a new sample reservoir (target tube). As discussed above, a micropipet is typically used for this purpose and the problem of material loss of sample occurs.

In addition, microconcentrator tubes do not readily fit into centrifuge wells. Many microcentrifuge designs are so small that such longer microconcentrator tubes also interfere with covering lids or with oppositely located tubes when placed in the rotor. Or they may, under the gravitational effect of centrifuging, tilt or cant to one side and spill, or the tips of the tubes touch bottom and become cracked or crushed and leak. All of these are consequences of design for one purpose that overlooks problems raised by such design in actual practice.

Accordingly, there is a definite need in the art for a connection-type centrifugal micro solution treatment system which includes a universal connection assembly for joining together a source microtube and target microtube in interchangeable fashion to permit repeated filtrations or treatments of a sample solution back and forth between the two microtubes without a significant loss of sample, and for adapters which permit retrofit usage in commercially available centrifuges without need for complete redesign of centrifuge rotors or covers.

In another biochemical arena, proteins exhibit a wide range of biological properties, particularly therapeutic properties in ameliorating various adverse medical conditions or diseases. There has arisen an entire field of characterizing the structure of such proteins. This is done by subjecting the proteins to repeated reactions to disassemble the constituent amino acids (herein AAs). A principal method is to use proteases, which are usually natural enzymes that can sever the peptide bonds between adjacent amino acids. Some proteases are highly site-specific, and can be used to fragment a protein into specific AAs or peptide fragments for sequence analysis.

Conversely, there is an entire biochemical/biopharmacological field of creating new peptides and proteins which are then assayed for biological binding activity against target molecules that have adverse biologic activity. A typical approach is to create vast, random, hexapeptide screening libraries of at least a substantial number of the 64 million possible hexapeptide combinations of the 20 L-amino acids, determining which are active in an iterative sequence, and then characterizing the sequence of the unknown active hexapeptides. In the iterative process it is common to build the hexapeptide one or two AAs at a time in a manner that requires some be blocked and others unblocked, at different times, so that all the possible random combinations of the hexapeptides can be assembled. This is called N-terminal blocking, typically by acylating the terminal amino group of a di, tetra or hexapeptide that has been secured to microbeads. Proteases are used to unblock, as well as to sever the peptide bonds so the hexapeptide or smaller peptide fragment of interest can be identified, eg., by High-Performance Liquid Chromatography (HPLC) or High-Performance Capillary Electrophoresis (CZE). For examples of the peptide library formation see U.S. Pat. No. 4,631,211, which sets forth the Houghton (Iterex) T-Bag method, and U.S. Pat. No. 5,143,854 which sets forth the Pirrung et al. (Affymax) photolithographic method.

One of the problems in this field is that thousands, or hundreds of thousands of peptide/protein fragmentation reactions must be run, and each takes time and space. Present instrumentation is now highly automated and sufficiently precise that micro-quantities of solution can be handled. This saves space and prevents mind-numbing repetition-type mistakes, but it does not solve the numbers or meniscus problem. Accurate amounts of reagents must be applied to thousands and thousands of test tubes or vials. Doing that sequentially introduces significant time lapse between microtube 1, and microtube 1,000 or 10,000. And the reactants must be fresh.

Accordingly, there is a need in this biochemical field for micro-analytic systems that permit accurate, simultaneous delivery or placement of precise quantities of known reagents in arrays of thousands of reaction vials for introduction of target solutions for treatment or analysis.

THE INVENTION

OBJECTS

Accordingly, it is a principle object of the present invention to provide a device which permits transfer of a sample solution with minimum loss between two centrifugal microtubes which are held together with their openings opposed facing each other by a connector in which a filter membrane may be installed.

It is another object of the invention to provide a method of efficiently transferring a sample solution simply by centrifugation such that solution transfer by pipetting is no longer necessary.

It is another object of the invention to provide an adapter system and assembly which permits the retrofit use of the new conjugate microtubes/connector assembly of this invention in commercially available centrifuges, particularly mini/micro centrifuges, without need for redesign of rotors or covers.

It is among the objects of this invention to provide a method, apparatus system in kit form, and product for treatment of micro-solutions employing known reagent(s) deposited on the inner surface(s) of treatment vial(s) in accurate predetermined quantitative amounts so that the solutions introduced (transferred therein) have quantitatively accurate amounts of reagent for reaction or treatment.

It is another object of this invention to provide a micro centrifugation vial having adhered to the walls thereof a predetermined amount of a known reagent or reactant which optionally can be maintained sealed in suitable packaging until use.

It is another object of this invention to provide a method, apparatus system and reagent coated vial which permits introduction of a solution in one vial and has a known quantity of a known dried reagent pre-introduced in another vial, the vials may then be connected one above the other with the solution below, and then upon inversion the solution contacts the reagent to commence treatment at a known time.

It is another object of this invention to provide a method and micro-solution dual microtube and connector assembly which includes a reagent-bearing filter to permit treatment of solution passing therethrough.

It is another object of this invention to provide a method and microsolution dual microtube and connector assembly which includes a filter having an indicator which changes color upon contact with a treatment solution passing therethrough.

The foregoing and other objects, features, aspects and advantages of the present invention will become more apparent from the following summary and detailed description of the present invention, when taken in conjunction with the accompanying drawings.

SUMMARY

The invention comprises a connection type treatment system and method for micro solution transfer which includes: 1) a first container (source or reaction tube) having a tubular shape with a first end open and an opposed second end closed, in which a reaction of a sample solution takes place; 2) a second container (target tube) of substantially the same shape as the first container with one end open and the other end closed; and 3) a connector assembly for connecting the open end of the first container and the open end of the second container, and also for applying predetermined treatment while passing the sample solution from the first container (source tube) to the second container (target tube). The connector assembly includes a connector member having a central through bore adapted to receive a membrane support containing an ultra filtration membrane. A stopper fits within the membrane support to hold the membrane in place. In an alternate embodiment, the membrane support is formed integral with the connector.

According to another aspect of the present invention, a method of treating micro solutions, using a connection type treatment system for micro solutions, includes the steps of executing a reaction of the sample solution inside the first container, connecting the open end of the second container to the open end of the first container using the connector assembly, turning the connected first and second containers upside down, and applying predetermined treatment using the connector assembly while passing the sample solution from the first container into the second container. At least one screw-on cap is provided for sealing either or both the source and/or target microtubes. The filter may also contain an indicator chemical to change color when the sample solution passes therethrough or when the treatment is effected, thereby to signal that the reaction treatment has been effected. Subsequent treatment of the prior treated sample solution may follow by passing the prior treated sample through a membrane having a reagent deposited thereon or by receiving the prior treated sample into a receiving microtube having a reagent on the inside walls thereof.

In yet another embodiment, a pretreated membrane having thereon a predetermined and precise quantity of reagent is seated within the connector assembly. The connector may be reusable by simply replacing the pretreated membrane, or it may be designed as a disposable, "single use only" reaction device thus ensuring the sterility of the connector and the accuracy of the test requiring that reagent. Further, an indicator means, such as a color indicator, would alert the operator that the disposable connector has already been used, or alternately, that the reagent is no longer fresh and the disposable connector should be discarded.

The conjugate or double ended microtubes/connector assembly is further characterized in that one microtube screws onto the connector while the second slip-fits thereon with the filtration membrane below the mouth or open end of the target tube.

The invention also includes a simple adapter assembly comprising a pair of concentric tubes, the inner, smaller one being shorter to provide an inner shoulder within the outer, larger, longer tube. The tubes are sized so that the microcentrifuge microtube of this invention easily slip-fits therein with the connector abutting the shoulder formed by the upper transverse end of the smaller tube, and the outer side wall of the connector slip-fitting within the outer tube. The grooves in the microcentrifuge outer wall, as well as providing a gripping surface, permit air to escape as the conjugate microcentrifuge microtube of this invention is inserted in the adapter tube assembly. While a single, internally stepped tube may be employed, we prefer to use commercially available plastic centrifuge tubes, the outer an 11 ml tube, and the inner an 8 mm tube. A hole may be provided in or adjacent the rounded bottom of either to permit escape of air as the inner tube is inserted in the outer. A plug-type pusher may be employed to fully seat the smaller inner tube in the outer. The adapter tube assembly easily retrofits into standard centrifuge rotors. The outer tube is made long enough to extend well up past the connector to provide good lateral support. The inner tube is long enough to permit the lower tip of the target microtube to clear the inner bottom thereof. That is the shoulder created by the inner tube is far enough up from the bottom to permit support of the conjugate, double ended microcentrifuge microtube at the connector, rather than at the tip of the target tube. This eliminates tip crushing and consequent leakage.

The adapter tubes assembly of this invention can be used to receive and hold types of microchemistry tubes and columns in centrifuge, such as gel filtration columns for a variety of applications, e.g., buffer exchange, purification, molecular size selection DNA, RNA, synthetic olionucleotides, peptides, proteins, ligated linkers, unincorporated dNTPs, polymerases, primers and the like.

The present invention permits simultaneous transfer of a sample solution between containers as well as a predetermined treatment of the solution using two containers and a specially adapted connector assembly for connecting these containers. Accordingly, use of transferring instruments, such as a micropipet, are not required, and the problems of sample loss and contamination risk are substantially reduced or minimized.

According to yet another aspect of this invention, a known dried reagent in predetermined quantity is deposited on the inner wall of at least one of the vials of a connectable, dual inversion vial assembly, which comprises a pair of micro vials and a special connector unit of this invention. Preferably, the vials are maintained in a sterile package prior to use. The package is opened and the two vials are arrayed in a suitable holder. If the treatment procedure requires, an ultra-filter is inserted in the connector unit. Alternately and preferably the connector unit includes a pre-packaged appropriate ultrafiltration membrane. The membrane may be untreated or treated with an appropriate reagent and or indicator for a particular procedure.

BRIEF DESCRIPTION OF THE DRAWINGS

The drawings illustrate the invention, which:

FIGS. 18*a* and 18*b* are a series of HPLC chromatographs, showing the peak heights of UV absorbance at 220 nm vs the elution time for an exemplary experiment conducted with the system and in accord with the method of the present invention wherein FIG. 18*a* is an HPCL chromatogram of a transferrin substrate and FIG. 18*b* is an HPLC chromatogram of neuraminidase enzymatic digestion of a transferrin substrate.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what Applicants presently believe is the best mode of carrying out the invention.

Figure 1:
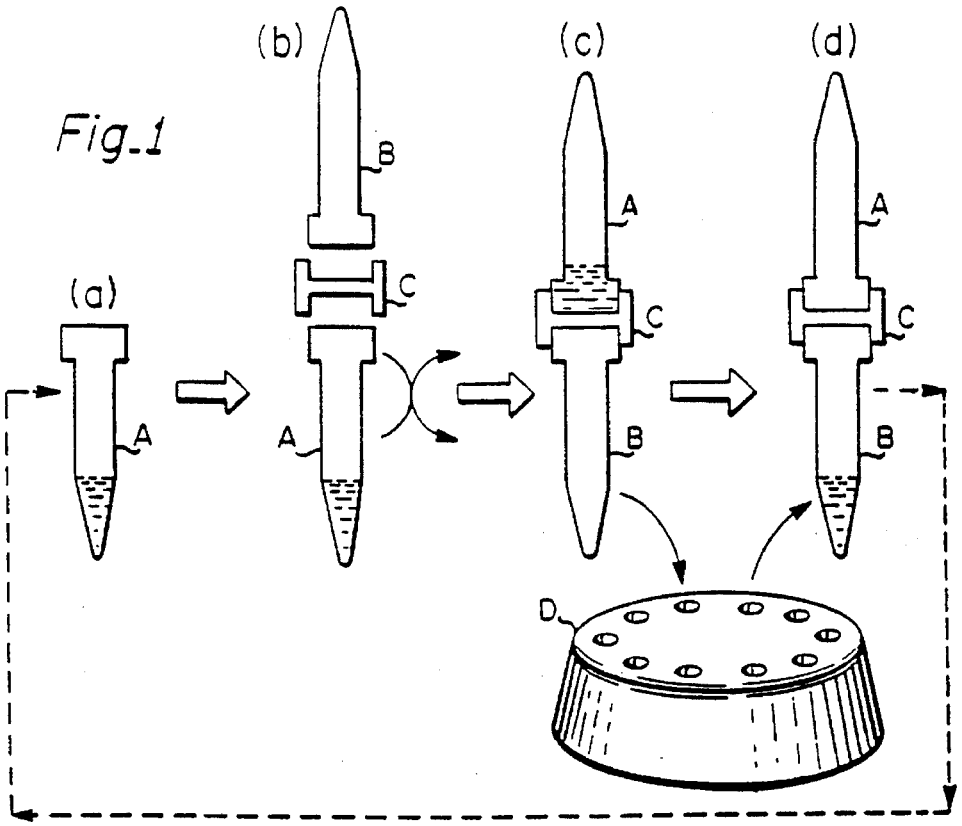
FIG. 1(*a–d*) is a schematic diagram of the principles of the present invention for a connection-type transfer and treatment system and method for micro solutions.

FIG. 1 is a diagram which illustrates in schematic fashion the overall system principles and method steps for the micro solution transfer and treatment system and method of the present invention employing a dual microtube and connector assembly. The presently preferred embodiments of the present invention relate to a treatment system and method for pretreatment of solutions for high performance liquid chromatography (HPLC) using an ultrafiltration membrane.

Referring to FIG. 1 (*a*) a researcher first carries out a predetermined chemical reaction such as, for example, an enzyme reaction, in a container or microtube A schematically shown in FIG. 1 (*a*). The resulting solution or product is designated by oblique dashed lines in FIG. 1. A cap (not shown) may be used on the open end of the tube.

Next, as is shown in FIG. 1 (*b*), at the end of the reaction, the experimenter then removes a cap (not shown) from microtube A and attaches one end of a connector C to the microtube A opening. A second container, indicated in the drawing as container or microtube B, having substantially the same shape as microtube A, is connected in upside-down fashion to the other side of the connector C. The connector C includes an ultrafiltration membrane (not shown) therein.

Next, as shown in FIG. 1 (*c*), the treatment system integrally formed of two microtubes A, B and connector C is inverted, as shown by the intertwined arrows, inserted in a centrifugal separator D, and then the centrifugal separator is spun. In this example, microtube A is referred to as the "source microtube" or "reaction microtube" and microtube B is referred to as the "target microtube" or "receiving microtube".

As a result of the centrifugation, as shown in FIG. 1 (*d*), the sample solution inside reaction (source) microtube A passes through the ultrafiltration membrane included inside connector C into the target microtube B. Molecules, stripped of solvent, having predetermined or larger molecular weights are trapped by the ultrafiltration membrane.

As described above, according to several embodiments of the present invention, the centrifugation is executed with the reaction microtube containing the sample solution, and the target microtube for receiving the centrifugation treatment being connected thereto via with the connector having an ultrafiltration membrane therein. Together the two microtubes and connector may be variously described as a dual, binary or conjugate microtube/connector assembly.

Therefore, by eliminating the need for use of a micropipet to transfer the solution between source and target microtubes, there is no solution loss due to solution remaining in the micropipet instrument. Also, possible contamination of the pipet is avoided. Further, as compared to when solution transfer is performed by a "direct pour" method whereby the contents of the reaction (source) microtube are poured into the target tube, virtually no sample solution residue remains on the inner source microtube wall in the present invention in view of the completeness afforded by filtration through centrifugation.

When executing a reaction in a plurality of steps, the treatment in the above FIGS. 1 (*a*)–(*d*) may be repeated in each step after the second step using microtube B (originally the target tube), now containing the filtered solution (FIG. 1 (d)), as the new reaction (source) microtube A', and adding a new target microtube B', and so on.

Figure 2:
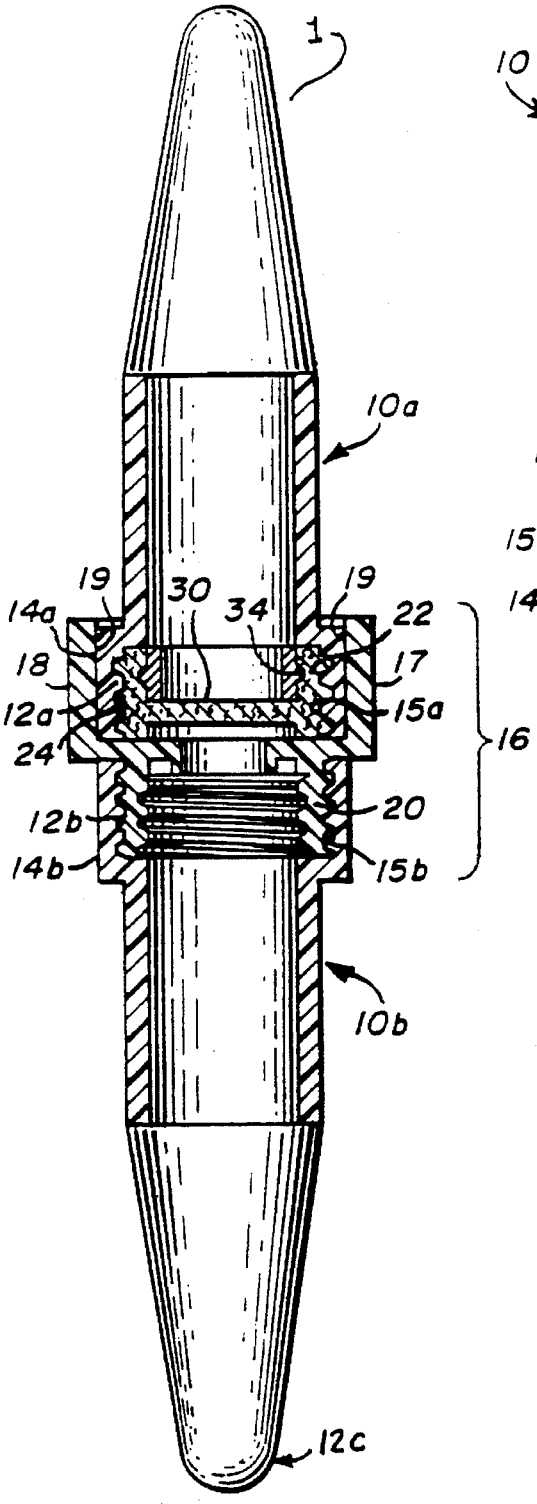
FIG. 2 is partial sectional view illustrating a specific structure of a centrifugal connection-type micro solution transfer and treatment device constructed in accordance with a first embodiment of the present invention.

FIG. 2 is a partial sectional view of a micro solution transfer/treatment system apparatus constructed in accordance with a first embodiment of the present invention. The micro solution treatment system apparatus 1 is illustrated in a connected state corresponding to the schematic representations of FIGS. 1 (*c*) and (*d*).

The micro solution treatment system apparatus 1 comprises two microtubes 10*a*, 10*b* each having a tapered, permanently closed end 12*c* and an open end 12*a*, 12*b* oriented opposed facing one another and joined together by a connector assembly 16. The microtubes 10*a*, 10*b* are similarly shaped and are constructed and adapted for use in a high speed microcentrifuge. They are preferably fabricated from a known plastic material of the type commonly used in micro-centrifuge applications, such as for example, polypropylene or polyethylene. The microtubes 10*a*, 10*b* correspond to the microtubes A and B of FIG. 1, respectively, and the connector assembly 16 corresponds to the connector C of FIG. 1. For the following description, microtube 10*a* will be referred to as the reaction or source microtube, and microtube 10*b* will be referred as the target or receiving microtube.

The connector assembly 16 comprises three principle elements including a connector member 17, a membrane support 22, and a stopper 34. The connector member or connector 17 is provided with two different connector ends for engagement with the microtube openings 12*a*, 12*b* of the respective microtubes 10*a*, 10*b* including a first connector end 18 defined as an open mouth-type member having tapered receiving inner walls 19 dimensioned for snug, slip-fit engagement with an outer peripheral wall 14*a*, 14*b* of a corresponding microtube opening 12*a* or 12*b*, and a second connector end 20 having a male screw portion 19 provided along its outer peripheral wall for engagement with a corresponding female screw portion 15*a*, 15*b* provided to an inner peripheral wall of a corresponding microtube opening 12*a*, 12*b*. In FIG. 2, the connector 17 is shown having its first connector end 18 fitted over the outer peripheral wall 14*a* of microtube opening 12*a* of the source microtube 10*a*, while the male screw portion 19 of the second connector end 20 threadingly engages the inner female screw portion 15*b* of microtube opening 12*b* of the target microtube 10*b*.

The membrane support 22 is provided with a male screw portion 24 formed along an outer peripheral wall and having threads sized for receivingly engaging the threads of the inner peripheral wall female screw portions 15*a*, 15*b* of a microtube opening 12*a*, 12*b*. In this example, the outer peripheral wall male screw portion 24 of membrane support 22 engages the inner peripheral wall female screw portion 15*a* of the source microtube opening 12*a*. The membrane support 22 is adjusted for receiving an ultrafiltration membrane 30 placed along a bottom supporting surface 26 thereof (See FIG. 5). A stopper 34 is provided for ensuring that the membrane remains fixed within the membrane support 22.

Figure 3A:
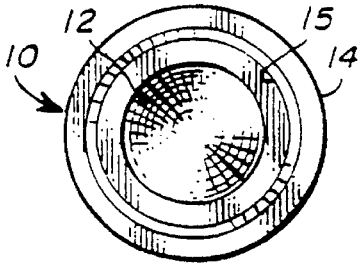
FIG. 3(*a–b*) is a diagram illustrating the structure of the microtube 10 shown in FIG. 2.
Figure 3B:
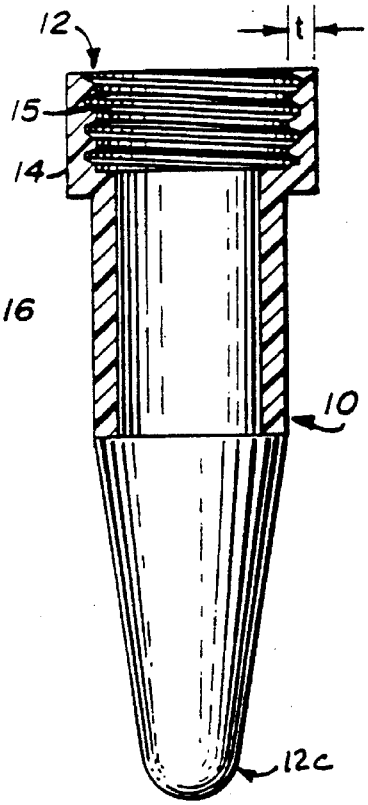

FIG. 3 is an enlarged two view diagram showing in more detail the structure of the microtube 10. In this case microtube 10 may be either source microtube 10*a* or target microtube 10*b*. In FIG. 3, part (a) is a plan view of the microtube 10 looking into the microtube opening 12, and part (b) is a cross-section view showing the flat outer peripheral wall 14, the tapered, permanently closed end 12*c* and the female screw portion inner peripheral wall 15 of the microtube opening 12. The wall thickness "t" of the microtube opening 12 preferably tapers slightly towards its free end to permit ease of insertion within the receiving connector end 18 of the connector member 17.

Figure 4A:
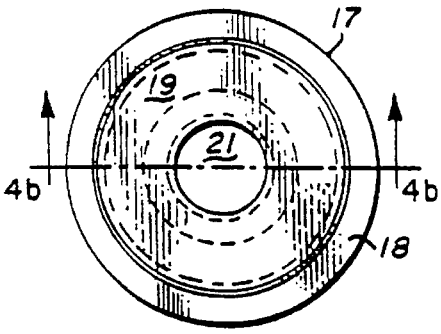
FIGS. 4A and 4B are diagrams illustrating structure of the dual microtube connector 16 shown in FIG. 2.
Figure 4B:
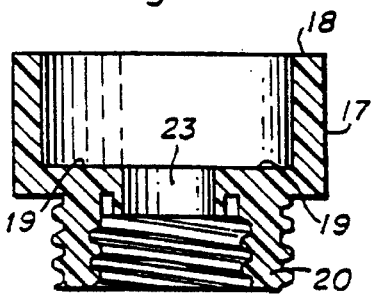

FIG. 4 is an enlarged two view series diagram showing structure of the connector 17 of FIG. 2 wherein part (a) is a plan view and part (b) is a cross-section view. The connector 17 is generally circular in cross section and includes an inner stop surface or ledge 19 against which end portions of the microtube opening 12 and membrane support 24 are constrained in abutting engagement when the system apparatus 1 is fully connected together (see FIG. 2). The connector 17 is provided with a central bore hole 23 for permitting transfer of solution material from a first microtube to a second microtube connected thereto.

In an alternate embodiment, the connector assembly may be provided with a membrane pretreated with a predetermined amount of reagent for use in performing tests requiring specific amounts of reagent. The connector may be reusable by simply replacing the pretreated membrane, or it may be intended as "single use only", whereby the connector and membrane are discarded after a single use. A further enhancement would be to include a color indicator that responds to the conditions during use by changing color. This would alert the technician that the connector had previously been used and should be discarded after the single use.

Figure 5:
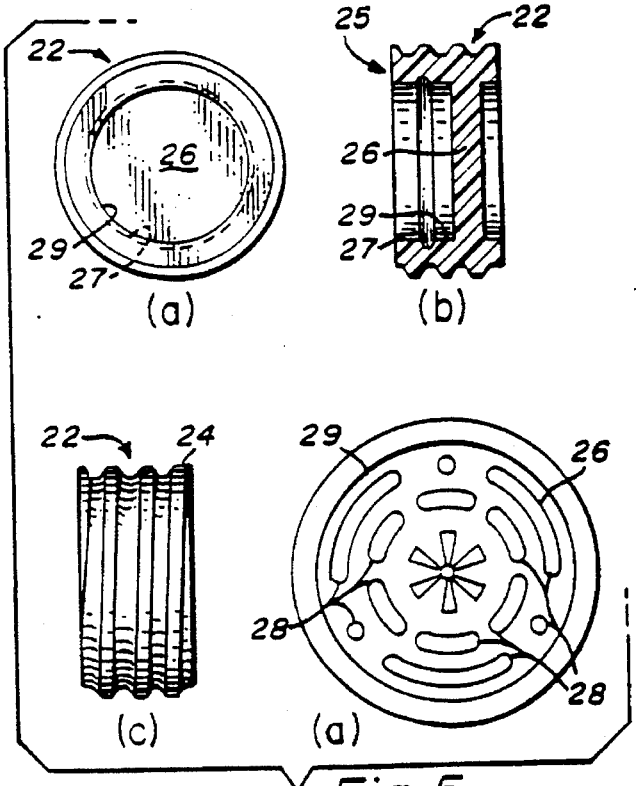
FIG. 5(*a–d*) is a diagram illustrating structure of the filter element supporting member 22 shown in FIG. 2.

FIG. 5 is an enlarged four-view series of diagrams illustrating the structure of the membrane support member 22 of FIG. 2 wherein part (a) is a top plan view (with details of the apertures supporting surface 26 being omitted for simplicity); part (b) is a cross sectional view; part (c) is a side elevation view; and part (d) is an enlarged bottom plan view showing the configuration of a plurality of through holes or ducts 28 formed in the bottom wall or membrane supporting surface 26 shown in part (a). Note, for purposes of clarity, the ducts 28 are not shown in the cross sectional view of part (b).

Figure 6A:
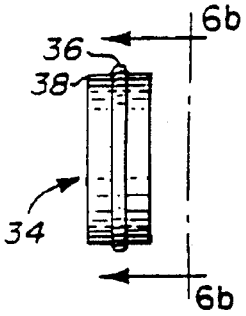
FIG. 6(*a–b*) is a diagram illustrating structure of the stopper 34 shown in FIG. 2.
Figure 6B:
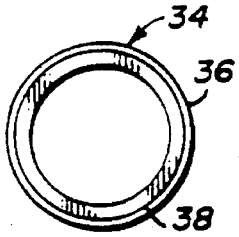

FIG. 6 is a two-view series diagram illustrating structure of tubular stopper 34 of FIG. 2 wherein 6(*a*) is a side elevation view, and 6(*b*) is a top plan view. Stopper 34 resembles a ring or tubular member and includes a circumferential rib 36 provided on its outer peripheral wall 38 which is adapted for snap-fit insertion within a corresponding convex groove 27 provided to the inner peripheral wall 29 of the membrane support 22 (see FIG. 5*b*).

Figure 21:
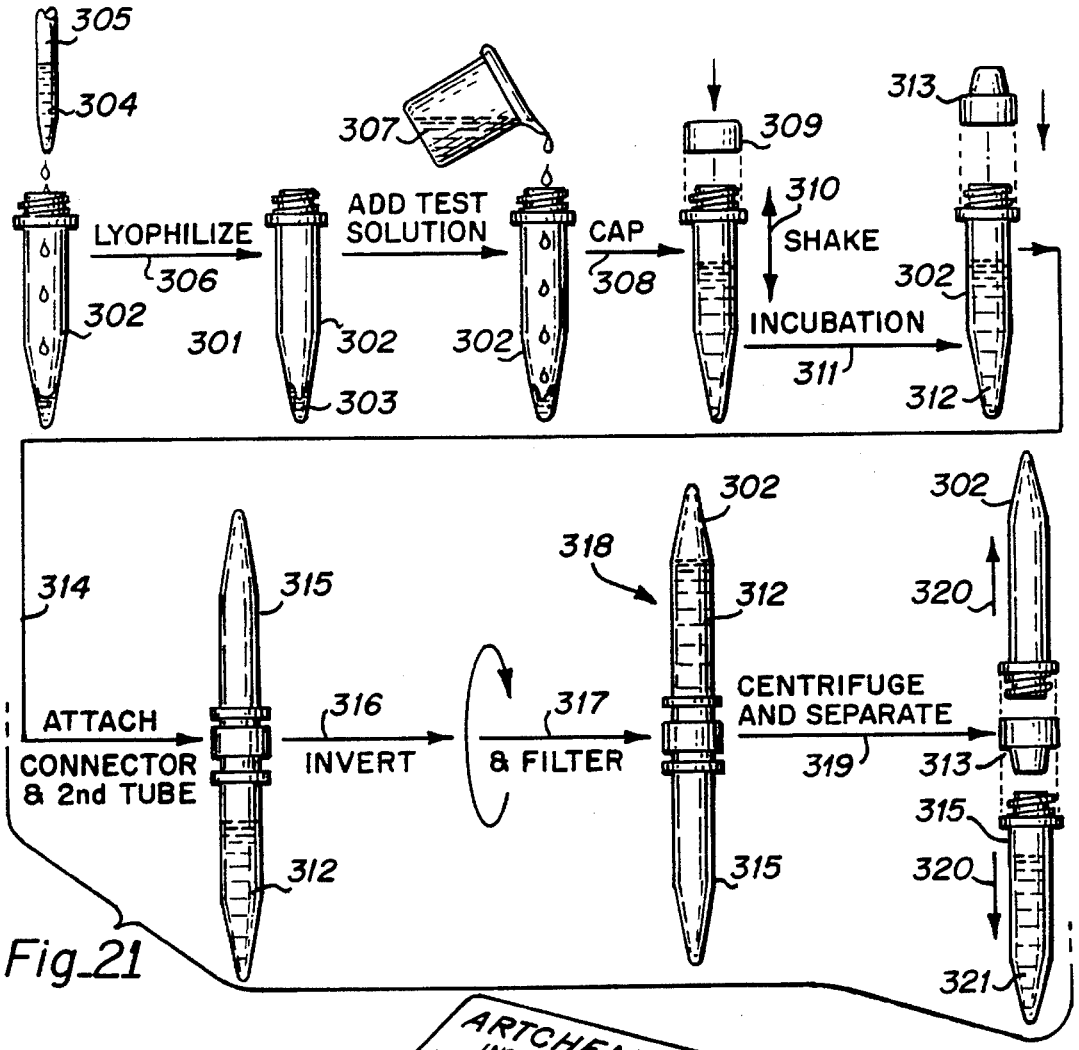
FIG. 21 is a schematic diagram illustrating the reagent-coated vial or microsolution reaction microtube, the system and the method of use of the invention, with a reagent deposited on the under side wall of at least one microtube.

Combination of two microtubes as described above in reference to FIG. 2 and below in reference to FIG. 7 can simultaneously achieve efficient transfer of solutions and the centrifugation treatment as shown in FIGS. 1 and 21.

Figure 7:
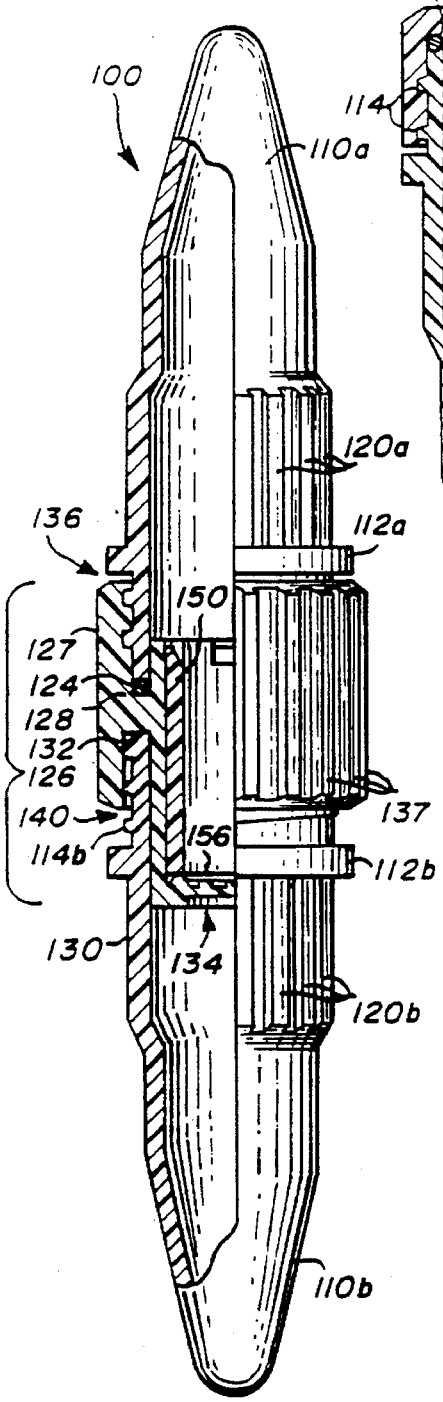
FIG. 7 is partial sectional view of a centrifugal connection-type micro solution transfer and treatment system constructed in accordance with a second embodiment of the present invention.

FIGS. 7–13 illustrate a second preferred embodiment for the microsolution/transfer treatment system apparatus of the present invention which is designated generally as element 100 in the drawings. Referring to FIG. 7, the second embodiment 100 for the microsolution treatment system apparatus comprises two similarly shaped containers or microtubes 110*a*, 110*b* each having an open end 112*a*, 112*b* which in use are connected together by a connector assembly 126. The connector assembly 126 of the second embodiment comprises two principle elements including a connector/filter retainer member 127 and a stopper 150.

Figure 9:
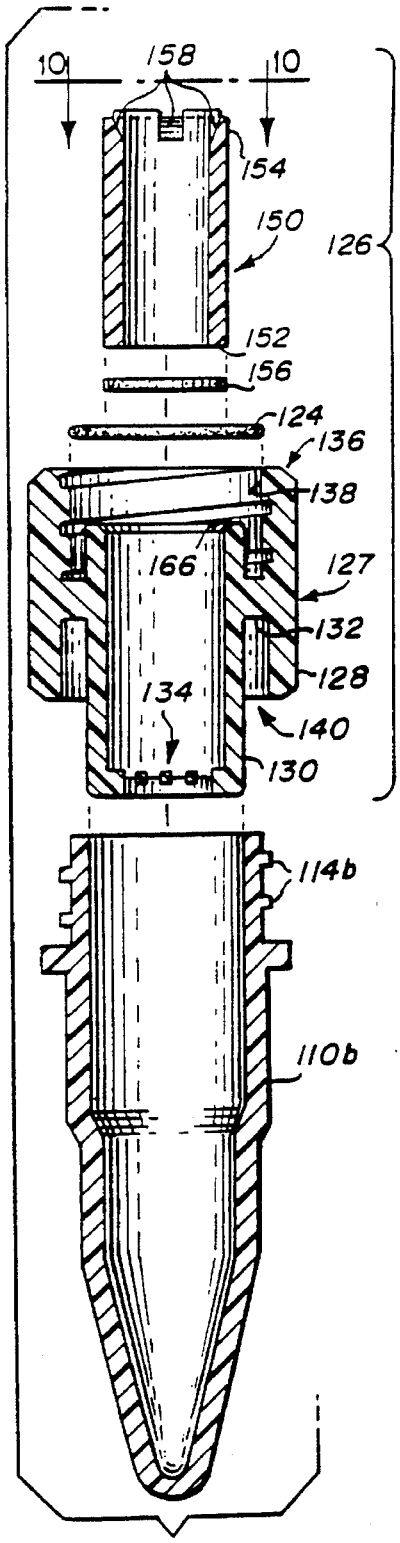
FIG. 9 is a cross-sectional exploded view of the second embodiment micro solution transfer/treatment device of FIG. 7 shown with the upper or source microtube 110*b* omitted.

As is best seen in FIGS. 7 and FIG. 9, the connector member 127 is formed as a bi-annular structure having an outer perimeter cylindrical shell portion or sleeve 128 surrounding an inner cylinder portion 130 and connected integrally thereto by a lateral, radially extending web 132. The outer shell (sleeve) 128 and inner cylinder define two connector ends including a first threaded connector end 136 and a second slip-on connector end 140. The outer shell portion or sleeve 128 is preferably serrated or knurled at 137 to facilitate handling by a user. Similar grip facilitating surfaces 120*a*, 120*b* may be provided to the outer surfaces of the microtubes 110*a*, 110*b*.

In this example, the threaded connector end 136 includes female screw threads disposed along an inner peripheral wall of the outer cylindrical portion 128 adapted to engage the male screw threads 114*a* disposed along the outer peripheral wall of the microtube opening 112*a* of microtube 110*a*. Also, the slip on connector end 140 fits over the open end 112*b* (and the male threads 114*b*) of the target microtube 110*b*. The inner cylinder portion 130 of the connector 127 also includes a transverse membrane support surface or region 134. In use, the connector member 127 is attached to the microtube opening such that the membrane supporting inner cylinder 130 is oriented to fit within the microtube opening 112*b* of the target microtube 110*b*. The membrane support surface 134 of the inner cylinder 130 defines a foramenous plate on which the ultrafiltration membrane 156 rests. The ultrafiltration membrane 156 is tightly held in place by a stopper 150 which fits within the inner cylinder 130 during use.

The preferred height dimension of the wall for the tubular stopper 150 and inner cylinder 130 is sufficiently high to ensure that all solution remains within the cylindrical volume defined by the bore of tubular stopper 150 during centrifuge operation such that a meniscus, which represents loss of solution, is not permitted to form above the stopper 150 or cylinder 130. This volume or capacity is typically on the order of 500 μl to 600 μl for microsolution work. Also, the wall height of the stopper 150 is preferably slightly less than the surrounding wall portion of the inner cylinder 130 so that the inwardly tapered ends 158 of the stopper 150 form a gradual transition to promote full flow of fluid in the downward direction from the source microtube into the target microtube during centrifuge operation. Also, the end walls forming the mouth opening of the inner cylinder 130 are preferably provided with a slight chamfer at 166 (see FIG. 9) to further promote complete flow of fluid down into the inner cylinder 130.

Figure 8:
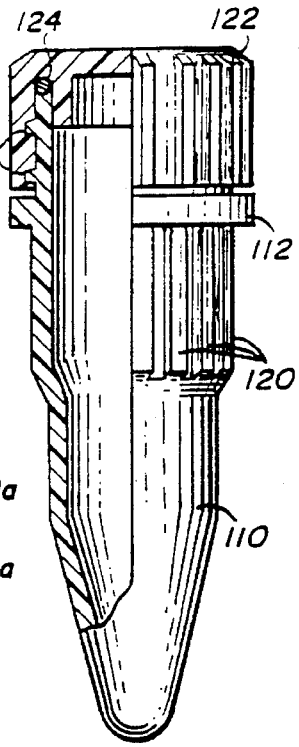
FIG. 8 is a partial section view of a microtube of the second embodiment micro solution transfer/treatment device of FIG. 7 shown here provided with a screw-on cap 122.

FIG. 8 shows a single microtube 110 having a screw top cap 122 for threading onto the outer male screw threads 114 of the microtube opening 112. The cap 122 includes an O-ring 124 to ensure against fluid loss. The screw on cap 122 is useful for sealing a source microtube 110*a*, such as for example after an enzyme reaction has occurred, or for sealing a target microtube after the desired treatment for the microsolution has been obtained.

Figure 11:
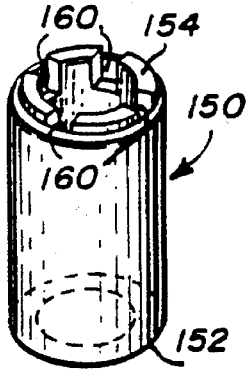
FIG. 11 is an isometric view of the stopper 150 of the second embodiment device of FIG. 7.
Figure 10:
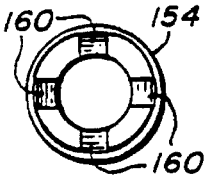
FIG. 10 is a top end view of the stopper 150 of the second embodiment micro solution treatment device of FIG. 7 taken along the line and in the direction of arrows 10-10 of FIG. 9.

Referring to FIGS. 9–11, the stopper 150 includes plurality of notched relieved portions 160 spaced equidistant along the top perimeter wall 154. These notched portions 160 facilitate press fit insertion of the stopper within the inner cylinder membrane support 130 of the connector assembly 126. The stopper 150 preferably includes a longitudinal groove (not shown) formed along its outer cylindrical wall to facilitate air exchange and thereby relieve any trapped air within the inner cylinder membrane support 130 and the stopper 150 when the stopper 150 is fitted within the membrane inner cylinder membrane support 130.

Figure 11A:
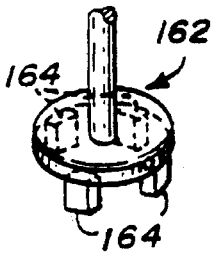
FIG. 11*a* is a perspective view of a tool 162 for inserting the stopper 150 into the inner cylinder 130 of the connector 126.

FIG. 11*a* illustrates an example tool 162 useful for inserting the stopper 150 within the inner cylinder 130. The tool 162 preferably includes axially extending peripheral tab members 164 for engaging the notched relieved portion 160 of the tubular stopper 150.

The top perimeter edge 154 of the stopper 150 is preferably tapered at 158 to ensure that all microsolution drains towards the ultrafiltration membrane during use and does not get trapped above the stopper perimeter edge 154. Similarly, all the edges contours of the notches 160 are preferably rounded to promote and ensure fluid flow.

Figure 12:
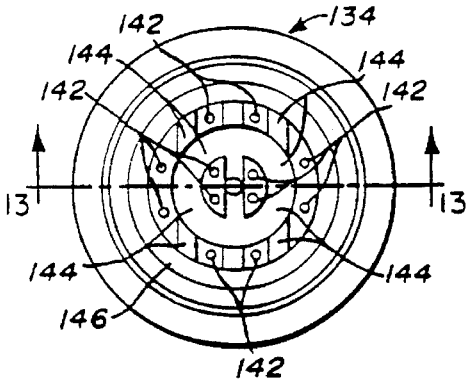
FIG. 12 is a top end view of the connector 126 of the second embodiment micro solution treatment device illustrating the membrane support region of the connector.
Figure 13:
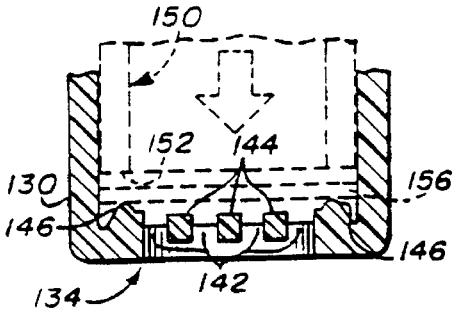
FIG. 13 is a fragmentary cross section view of the membrane support region of the connector of the second embodiment micro solution treatment device taken along the line and looking into the direction of arrows 13-13 of FIG. 12.

FIGS. 12 and 13 illustrate in more detail the generally foramenous plate-like membrane support region 134 of the inner cylinder 130 of the connector 127. The porous plate region 134 includes a plurality of arcuate and semi-arcuate through holes or ducts 142 interspaced by ribs or land portions 144. At its outer periphery the membrane's support region of foramenous plate 134 includes a slightly upraised rib member 146 having a peak disposed coordinately aligned with lower end wall 152 of the tubular stopper 150 when the stopper 150 is fitted within the inner cylinder 130. This is best seen with reference to FIG. 13 (stopper 150 and membrane 152 are indicated in phantom). In this way, the membrane 156 is maintained taut and prevented from moving by the engagement of the bottom end wall 152 stopper against the upraised rib member 146.

Figure 14:
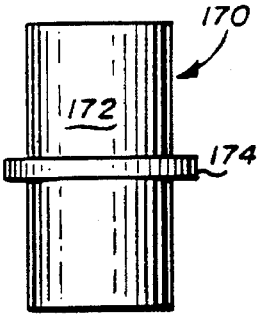
FIG. 14 is a side elevation view of an adapter 170 used for securing the second embodiment for the microsolution treatment device of the present invention in a centrifuge rotor.
Figure 15:
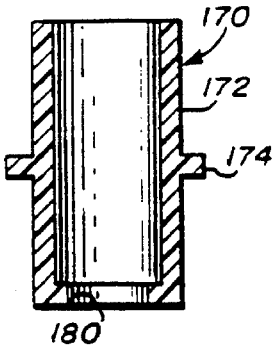
FIG. 15 is a side elevation view in cross section of the adapter 170 of FIG. 14.
Figure 16:
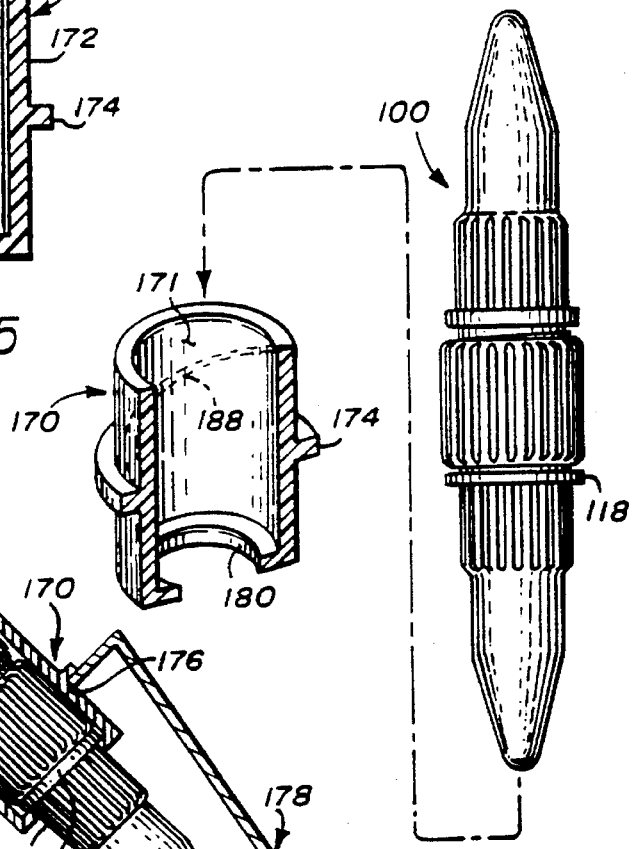
FIG. 16 is an isometric view illustrating how the second embodiment micro solution treatment device fits within the adapter (shown in cross-section)

FIGS. 14–16 show a first embodiment of an adapter 170 which may be used for fitting the first or second embodiments of the microsolution transfer/treatment system 100 within a receiving socket of a centrifuge rotor. In view of the added circumferential girth provided by its additional connecting elements, the microsolution treatment system has a slightly increased outer radius as compared to conventional centrifuge tubes. Accordingly, a wider diameter socket in a centrifuge rotor is preferably provided for receiving the dual tube/connector system. For this purpose an adapter 170 is provided to ensure proper fit and support of the microsolution system 100 within the centrifuge rotor. The adapter 170 is generally cylindrical in cross section and has an inner diameter sized for a close tolerance fit with the connection-type microsolution system when inserted in it. The outer surface of the adapter 170 is provided with a laterally extended circumferential ledge member 174 (an annular flange), which acts as a stop member and rest support when fitted into a receiving socket 176 of a centrifuge rotor.

Figure 17:
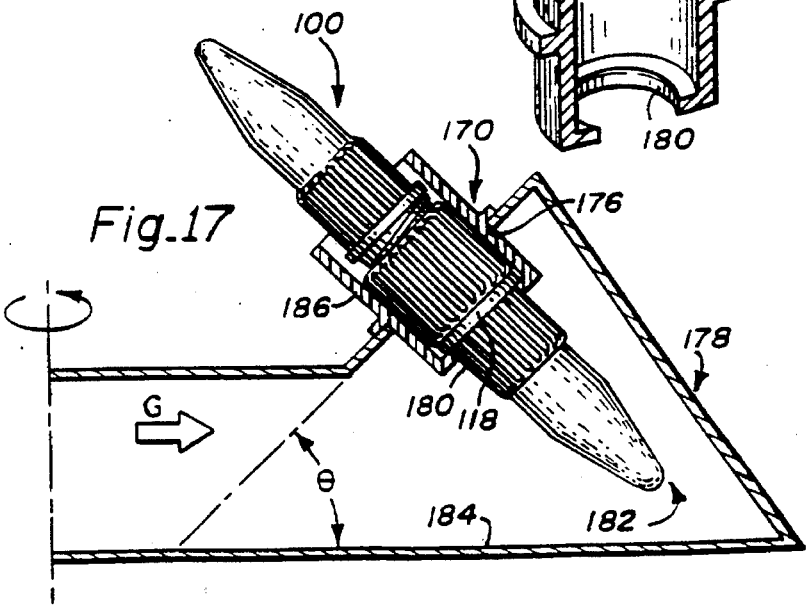
FIG. 17 is a functional schematic view in partial cross-section of the second embodiment micro solution treatment device of the present invention held by the adapter and positioned in a fixed angle rotor.

FIG. 17 shows the system apparatus 100 placed within the adapter 170 and inserted within an appropriate receiving socket or hole 176 of a rotor 178. The adapter includes at its bottom end a reduced radius opening 180 sized to engage an outer portion of one of the microtubes of the microsolution system 100 at a location along the bottom microtube adjacent the connector assembly, such that the bottom end 182 of the system apparatus 100 is prevented from contacting a base portion 184 or side wall 185 of the centrifuge rotor 178. The upstanding walls 186 of the adapter 170 above the ledge member 174 are of sufficient length to ensure adequate support of the connection-type microsolution treatment system apparatus during centrifuge operation.

As is best seen in FIG. 16 the forward portion of the adapter may be cut away (indicated in phantom) at 188, thereby leaving only a high back supporting portion of the upper adapter walls above the annular flange or ledge member 174. (The cut away portion is indicated as element 171.) In this way, a lightweight adapter having sufficient support for reducing stresses placed on the system apparatus from centrifuged forces is achieved.

Figure 19:
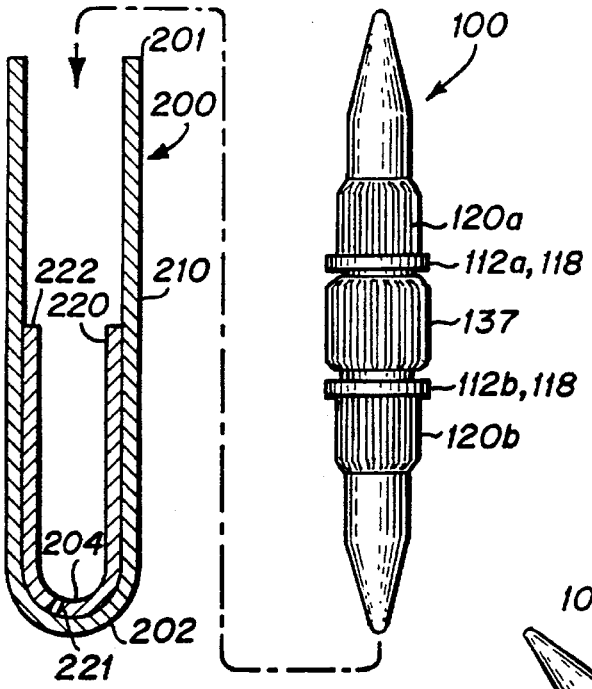
FIG. 19 is the side elevation view in cross-section of the universal adapter of this invention used to retain the preferred embodiment of the conjugate tube/connector microsolution treatment assembly of the present invention in a conventional centrifuge rotor, and conversely, shows how the binary microtube assembly fits within the adapter tube assembly.

FIG. 19 shows a universal adapter 200 which may be used for fitting the first or second embodiments of the microsolution transfer/treatment system 100 within unmodified rotor sockets of larger centrifuge machines; i.e., retrofit without requiring redesign or new rotors or covers. Larger centrifuges of this type are manufactured by International equipment Company and include their Centra Series models MP4 and MP4R centrifuges employing their 809 or 819 rotor systems. The outer tube 210 is a standard cylindrical plastic centrifuge tube, e.g., an 11 milliliter tube, having an open end 201 and a sealed end 202. In the preferred embodiment, the outer tube has a length of 85 mm and an outer diameter of 16.8 mm. The inside diameter of the outer tube is sized sufficient to removably receive therein the dual tube/connector assembly.

Figure 20:
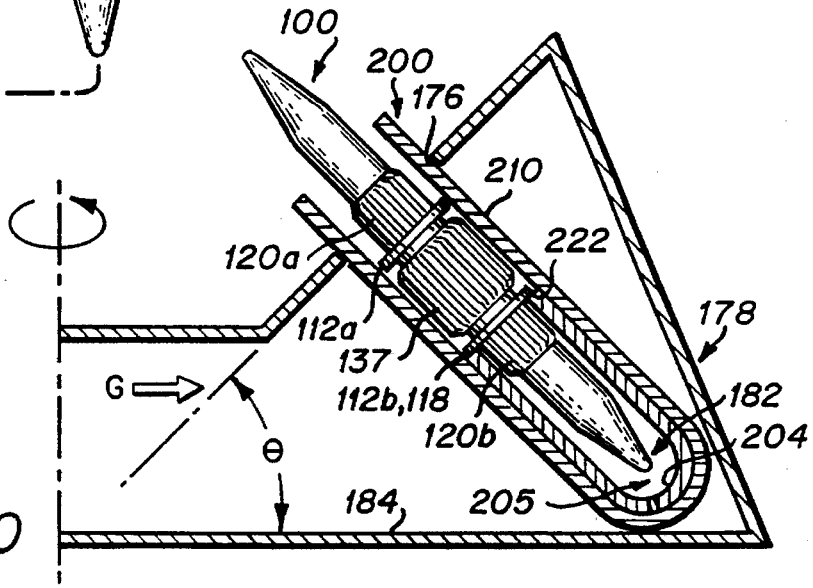
FIG. 20 is a functional schematic view in partial cross-section of the preferred embodiment dual tube/connector assembly of the present invention positioned in the adapter assembly in a fixed angle rotor.

The shorter, inner tube 220 is also a standard 8 milliliter cylindrical tube having an outside diameter slightly less than the inside diameter of the outer tube 210 so that it may be snugly disposed in a close tolerance fit within the outer tube and positioned towards the sealed end of the outer tube. These tubes are commercially available from Sarstedt, Inc., of Newton, N.C. The sealed end of either the inner tube 220 or the outer tube 210 is punctured with a small hole 221 to allow entrapped air to escape as the shorter inside tube is inserted and positioned within the outer tube. The axial length of the shorter inner tube is less than the outer tube and is cut transversely to create a shoulder or annular ledge 222. The inside diameter of the inner tube is sized to permit slip fit engagement with an outer portion 110 of one of the microtubes (the target tube) of the microsolution dual tube/connector system 100. The axial length of the shorter inner tube determines the axial location of the annular ledge 222 which engages and supports the flange **112*b*, 118 of the receiving microtube 110*b*. The length of the inner tube is predetermined to allow the target microtube to be supported with its tip 182 free from engagement with the inner bottom 204 of the inner tube 220. The clearance 205 is best seen in FIG. 20. In addition the reaction microtube of the microsolution dual microtube system facing the open end of the outside tube protrudes sufficiently through the open end of the outside tube so that it may be grasped and removed when it is desired to remove the microsolution dual microtube system from the universal adaptor assembly 200**.

FIG. 20 shows the system apparatus 100 placed within the universal adapter 200 and inserted within an appropriate receiving socket or hole 176 of a centrifuge rotor 178. As the conventional rotor receiving socket is designed to accommodate a standard centrifuge tube of the type used for the outer adaptor tube 210, the adapter is adequately supported within the rotor during centrifuge operation. The resulting total length of the system apparatus 100 when inserted within the universal adapter 200 is preferably less than or equal to 105 mm. FIG. 20 shows the bottom or sealed end of the adapter 200 resting against the walls of the rotor housing 184. Other centrifuge rotor receiving designs may include cups, bores, buckets, or stirrups to accept the centrifuge tube and may be either fixed, as shown, or allowed to swivel. Regardless of the type, as the outer tube 210 is a standard centrifuge tube, and where the rotor receiving socket is designed to accept such standard tubes, the universal adapter 200 of the present invention will be adequately supported.

The invention is further illustrated by the following non-limiting example.

I. TRANSFER AND TREATMENT EFFICIENCIES

EXPERIMENTAL SECTION

Sample microtubes and connector of the design of FIGS. 1–6 were made of polypropylene with a 1.6 ml total microtube volume (each tube). Human transferrin and TPCK-trypsin were obtained from Sigma (U.S.A.). Transferrin was reduced with dithionerethreitol and alkylated with iodoacetamide, by known procedures, to be used as the substrate for trypsin. High performance liquid chromatography of the tryptic peptides was performed on a Dionex Gradient pump equipped with a Rheodyne 7125 injector (20 μl-loop), a Shimadzu SPD-6A UV monitor and a Shimadzu CR-6A chromatorecorder. A sample solution (5 μg as protein/5 μl) was injected onto a Cosmosil octadecyl RP-HPLC column (5 μm, 0.6×15 cm, Nacarai Tesque, Japan) equipped with a guard column (0.6×1 cm). The column was eluted at 0.8 ml/min with 300 mM boric acid buffered to pH 7.0 with triethylamine and a linear gradient of 10 to 30% acetonitrile in 50 min. The peaks were detected by monitoring the absorbance at 220 nanometers.

Efficiencies of the transfer between microtubes

A described volume of water (50, 200, and 500 μL each) was added into a source microtube (110*a*), which was previously weighed accurately. The total weight of the microtube and water added was then weighed. The connector, fitted with a filtration membrane, (0.45 μm average pore size, Millipore) was then tightly screwed to the source tube. The second microtube (target tube), of which the weight was also weighed accurately, was then slipped over the other end (target side) of the connector. The assembly or connected system apparatus was then turned upside down and placed into a microcentrifuge (Beckman Microfuge 11-type). After centrifugation (5 min. 12,000 rpm), the microtube at the target side was removed and weighed accurately to determine the amount of water transferred. The recoveries were calculated from the ratios of the weight of water before and after transferring. The transfer experiments were repeated five times for each volume of water.

As a reference experiment, microfiltration tubes (Millipore, pore size 0.45 μm) of 1.5 ml volume were used and measured recoveries were achieved after transfer in the following manner. A measured volume of water (50, 100, 400 μl) was transferred to a sample microtube (500 μl) with a micropipet. The microtube containing water was weighed accurately. The whole volume was carefully transferred to a microfiltration microtube by the same micropipet with a polypropylene tip. The micro-filtration microtube without filter port was previously weighed. The tubes were centrifuged at 12000 rpm for 5 min. The recoveries were calculated from the weights in the polypropylene microtube and microfiltration tubes at all level of the volumes (50, 100 and 400 μl) examined.

Filtration of tryptic digestion mixture of human transferrin

A sample of the reduced and alkylated transferrin (100 μg) was dissolved in 50 mM ammonium bicarbonate buffer (pH 8.0, 100 μl) containing 1 μg of TPCK-trypsin. The mixture was incubated overnight at 37° C. After heating for 3 min in a boiling water bath, the mixture was treated with the conjugated invertible transfer system of this invention equipped with a membrane (0.45 μm average pore size, Millipore) . The time required for filtration of the mixture by centrifugation (12000 rpm) was about 5 min. A portion (5 μl) was injected to the HPLC column. Another sample of the reduced and alkylated transferrin (100 μg) was also digested in the same manner as described above. The reaction mixture was also treated with the conjugated invertible transfer system equipped with a ultrafiltration membrane (Amicon YM05, molecular cut off, 5000) . The time required for filtration of the mixture by centrifugation (12000 rpm) was about 30 min. A portion of the mixture (5 μg/5 μl) was also injected to the HPLC column.

RESULTS AND DISCUSSION

The efficiencies of transfer of the solution from the microtube A (source tube) to the microtube B (target tube) are summarized in Table I below. Using polypropylene microtubes (1.5 ml volume), different volumes of water (50, 200, and 500 μl) were transferred. Recoveries were excellent at every volume examined (>99%). Relative standard deviations (<0.5%, n=5 in each volume) in recoveries were also excellent.

TABLE I

Efficiencies of the Transfer by Conjugated Invertible Sample-Transfer System

| Sample No. | Amount added as weight (mg) | Amount found as weight (mg) | Recovery (%) |
|---|---|---|---|
| 1 | 49.3 | 49.2 | 99.8 |
| 2 | 48.9 | 48.5 | 99.1 |
| 3 | 50.3 | 49.9 | 99.2 |
| 4 | 48.8 | 48.6 | 99.6 |
| 5 | 49.2 | 49.0 | 99.6 |
| 6 | 202.3 | 199.4 | 98.6 |
| 7 | 201.5 | 199.8 | 99.2 |
| 8 | 200.9 | 199.9 | 99.5 |
| 9 | 201.2 | 199.9 | 99.4 |
| 10 | 204.6 | 203.8 | 99.6 |
| 11 | 494.2 | 493.0 | 99.8 |
| 12 | 495.4 | 495.9 | 100.1 |
| 13 | 499.8 | 498.9 | 99.8 |
| 14 | 499.7 | 498.7 | 99.8 |
| 15 | 498.1 | 496.3 | 99.6 |

Average of recoveries: 99.5%.
Relative standard deviations: 0.37%.

Figure 18A:
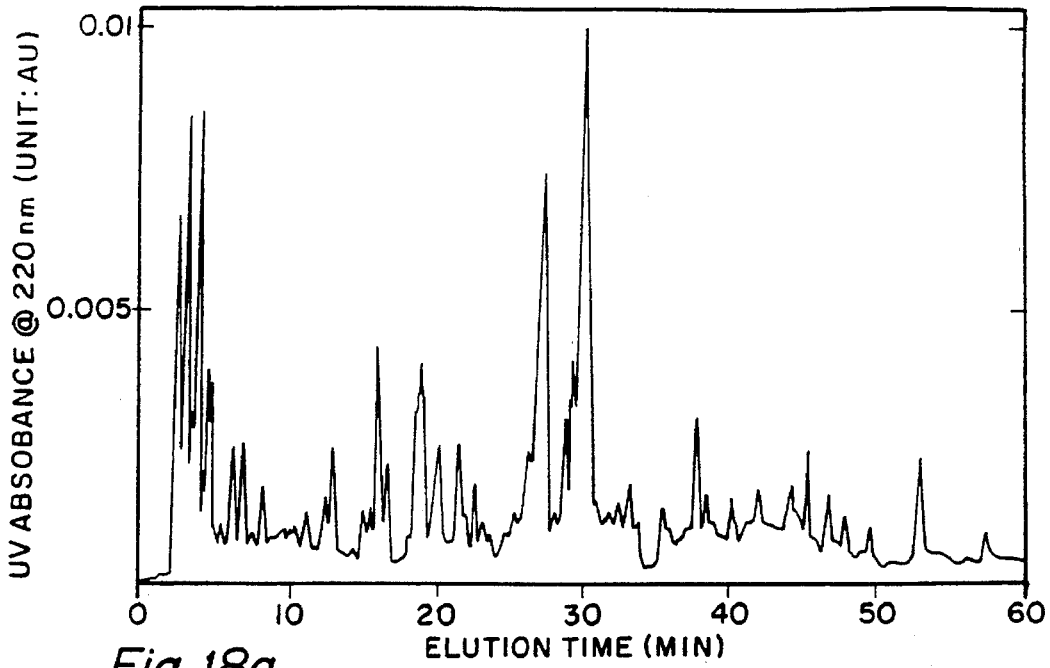
Figure 18B:
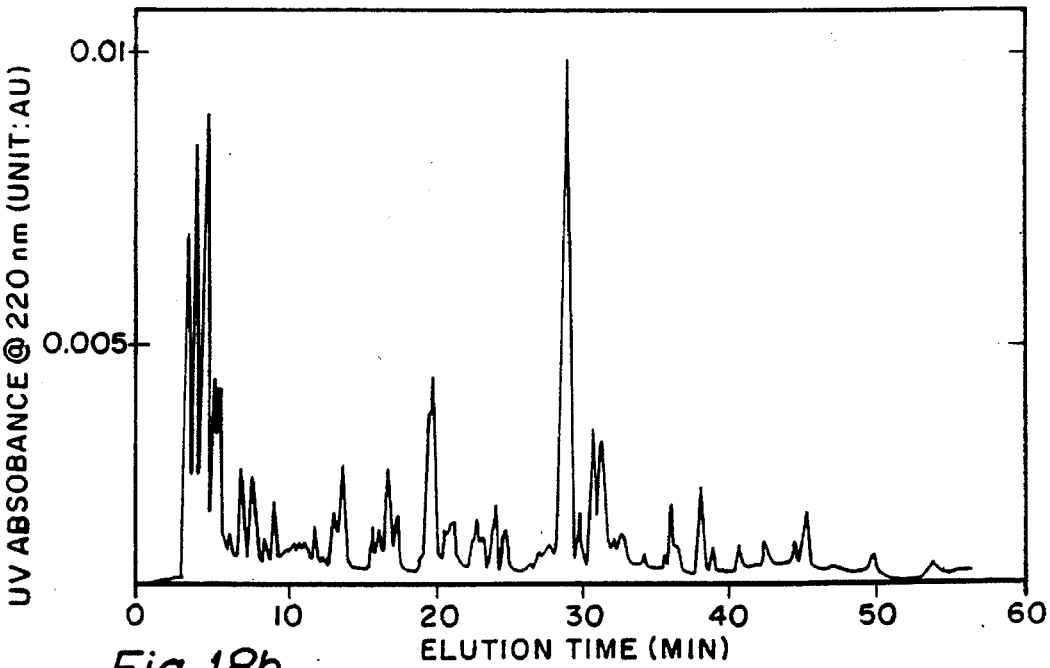

Control studies using microfiltration tubes including the solution-transfer procedure by a piper showed a consistent loss of 3.1 mg of water in all volumes examined. These losses are attributable to the residual water in the sample microtube and pipet tips. When transferring 50 μl of sample solution, the loss was 6%. The loss was 0.75% in the transfer of 400 μl-sample. Thus, transfers of smaller sample solutions present a much more serious problem. The chromatogram results (UV absorbance versus elution time) for an example application for the described connection-type microsolution treatment and transfer system of this invention for high performance liquid chromatography of tryptic peptides of human transferrin is shown in FIG. 18 and is discussed in Example 4 below. The result obtained from the analysis of the filtrate through micro filtration membrane (0.45 μm average pore size) is shown in FIG. 18*a*. The result obtained bypassing through a ultra-filtration membrane (molecular weight cut off, <5,000) was also shown in FIG. 18*b*. Some distinct differences are observed. Peaks observed at 22 min, 26 min and 32 min in the chromatogram (a) disappeared in the chromatogram (b). These peaks are probably due to trypsin and large peptide fragments.

The present method minimizes labor and material loss in sample handling. The strength of the described system lies in the fact that the source microtube and the target microtube are physically identical and interchangeable, as well as that the membranes are easily exchangeable. This allows for great flexibility. For example, a series of transfers using only two microtubes, but different membranes, may be carried out for stepwise size fractionation of proteins or serial lectin affinity chromatography for fractionation of oligosaccharides. Combination of several kinds of ultrafiltration tubes can accomplish fractionation according to the molecular mass. By modifying or changing the membranes to be immobilized with affinity ligands, the connectors can also be used for affinity separations.

Although the above-described embodiment concerns a system for pretreatment of high performance liquid chromatography in which an ultrafiltration membrane is provided in a connector portion, in another embodiment of the present invention a pretreatment system utilizing affinity can be implemented by providing an affinity functional membrane in the connection. For example, the connector membrane may contain antibody or antigens and lectins or an ion-exchange membrane, or a membrane having other suitable functions.

Also, the two centrifuge microtubes are made having the same shape in the above embodiment, but microtubes having different shapes can be employed as needed. Further, the orientation of the male/female screw portions of the microtubes and connectors may be reversed if desired.

As described above, the present invention permits carrying out transferring of sample solutions between microtubes as well as predetermined treatment using two microtubes and a connector for connecting the microtubes. Accordingly, a transfer instrument for transferring such as a micropipet is not needed, which minimizes the loss of sample and enables reduction of the risk of contaminations of instruments, particularly when executing a reaction in plural steps.

II. USE OF DUAL MICROCENTRIFUGE MICROTUBE/CONNECTOR SYSTEM IN A BIOCHEMICAL MICROANALYSIS KIT

FIG. 21 schematically illustrates the method, system and prepackaged reagent-bearing vial or microsolution reaction microtube 301 of kit application of this invention. For purposes of this detailed description, the vial comprises a tapered micro-centrifuge microtube 302 of this invention on the inner surface of which is coated a reagent 303, which is generally dry, but may be a gel or other type of coating. The term "reagent" as used herein is meant broadly as any compound, composition, mixture or element which has a chemical, physical or biochemical effect on a reactant placed in contact therewith. By way of example, and not by way of limitation, the reagent described in more detail herein is an enzyme, such as a protease, but may be a neutralizing, acidifying, buffering, alkalizing, catalytic, complexing agent, or the like, or a compound, mixture or composition which inter reacts with one or more components of a fluid mixture, composition, or compound placed therein, such as an acylating, amidating, oxidizing or reducing agent, and the like.

Typically the reagent, e.g., enzyme 303 is coated on the inner surface of the microtube 302 by lyophilizing 306 a solution 304 of appropriate volume and concentration to provide on the surface a known quantity, e.g., by weight (g., mg., μg., ng., etc.) or by moles (millimoles or μmoles) of the desired reagent. The introduction of enzyme solution 304 by pipette 305 is a convenient method of providing the solution to microtube 302 prior to lyophilization 306.

Optionally, the microtube 302 may be rotated, vertically or at an angle while lyophilization is carried-out, in order to evenly spread the reagent on and/or up the inner wall to provide a microsolution reaction microtube. It is helpful, and in some cases important, to avoid an excess accumulation of reagent in the very bottom vertex of the tapered microtube as mixing of some solutions in the tiny vials may be difficult, and complete and rapid treatment of test liquid subsequently introduced is important. Tipping the micro-tube and rotating while drying to spread reagent-containing fluid well up the inside wall from the inner vertex is one way of accomplishing even layering. The reagent should not be spread so high up the walls that any significant quantity is above the projected top surface of the subsequent reactant (test) solution 307 introduced into the vial. This height is typically from ½ to ⅞ the inner wall height measured up from the vertex, with the bottom surface of the ultrafiltration support being 100%.

Alternate methods of introducing and coating the inner walls include spray coating, vapor deposition and use of active groups chemically adhered to the wall to bind the selected reagent. Alternately, the membrane may be pretreated with a predetermined amount of reagent so that the liquid is treated as it passes through the membrane. Another alternate method is to provide a "single use only" connector having disposed therein a pretreated membrane as described above. Still another embodiment includes a means for determining whether the single use connector has been used and should be discarded, e.g. by use of an indicator or a reagent in the membrane or in the connector which changes color when exposed to moisture, high or low pH, proteins, and the like to indicate the prior use, i.e., prior passage of a fluid therethrough.

Referring to FIG. 21, it should be understood, however, that lyophilizing the enzyme solution 304, which is poured, pipetted 305 or otherwise introduced into the vial 302 while the vial is in a vertical position is generally sufficient, and the lyophilized coating 303 may be predominantly at the inner vertex of the microtube 302, as shown.

Continuing now with FIG. 21, an appropriate protein in a water or a diluted buffer test solution 307 is added to the vial 301, and capped 308 with cap 309, shaken 310, incubated 311 to produce a reaction mixture 312 in the tube. A connector element 313 is placed 314 on the microtube 302, or on microvial (second tube) 315 and secured (by threads or press fit) onto the top of microtube 302 containing reaction mixture 312. Typically the connector element 313 contains a microfiltration membrane (not shown).

The resulting dual microtube (vial) assembly is inverted 316, and the reaction mixture is now (momentarily) in the top microtube as shown at 318, and is filtered 317 as it descends into empty bottom microtube 315. This assembly is typically centrifuged as at 319. After centrifugation the assembly is taken apart at 320, and filtered reaction mixture 321 in recovery microtube 315 is recovered, assayed, further treated, etc., as required by the selected procedure. Typically the enzyme remains on the filter medium in connector 313. In other procedures, a precipitate could be centrifuged to the bottom of microtube 315, and the supernatant, precipitate or both recovered as desired.

Figure 22:
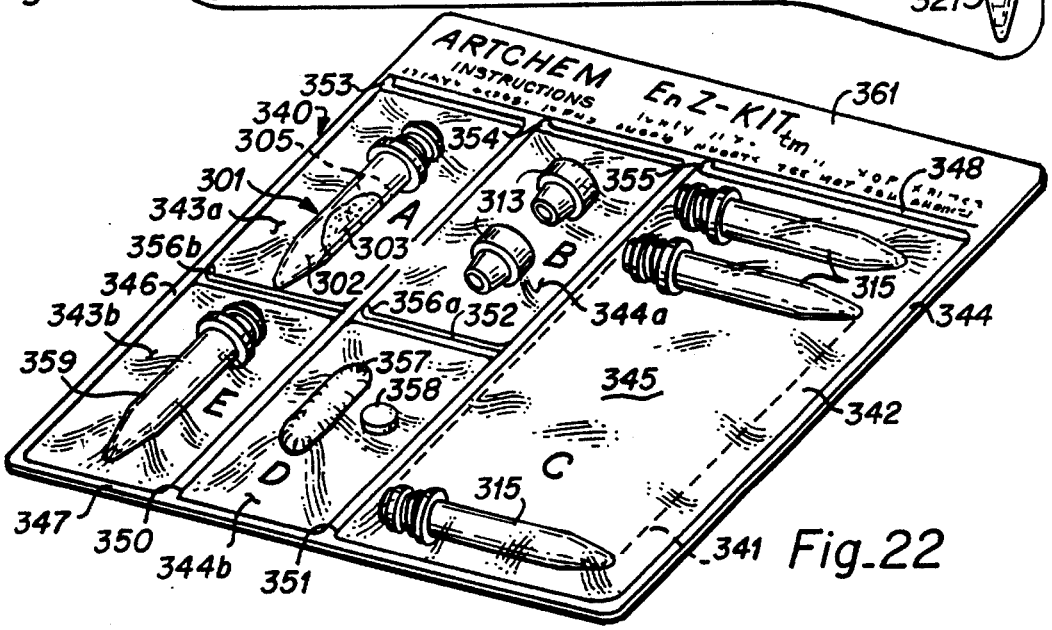
FIG. 22 is an isometric view of a pre-packaged, dual vial system kit ready for use, which includes at least one vial with precoated reagent on the inner wall.

FIG. 22 is an isometric rendering of one example of a kit containing one or more prepackaged enzyme microtubes of this invention in a sterile prepackaged pouch 340 which may be single, or multi-part as shown. The pouch 340 shown may be of any suitable medical type packaging film, made preferably of a bottom sheet 341 sealed to a clear transparent top sheet 342, and having a plurality of sub-packets 343 (343*a*, 343*b*), 344 (344*a*, 344*b*), 345 defined by marginal seal lines 346, 347, 348 and 349, and medial seal lines 350, 351 and 352. Each sub-pouch may include conventional tear-open tabs 353, 354, 355, 356*a*, 356*b*. The vials, connectors, and optionally ampoules or tablets of buffer are sealed in the various portions of the pouch. If necessary, the empty vials are easily sterilized. Suitable identification and instructions may be included on a header portion 361, if desired. As an option, the pouch may instead be an acrylic or styrene box having appropriately contoured cradles to retain the microtubes.

As shown, a plurality of enzymes microtube 301 (typically 9 of them) are packaged sealed in pouch area A, the connectors 313 (typically 10 of them) are in B, the receiving microtubes 315 (typically 10 of them) are in C, ampoule(s) 357 or tablet(s) 358 of buffer are included in D; and a substrate vial 359 in E. As shown, microtube 302 contains a reactant such as an enzyme 303 coated on the inner wall to the height 360. A typical neuraminidase enzyme kit would contain 9 enzyme microtubes, 1 substrate tube, 10 empty vials, 10 connectors and 1–2 ampoules of buffer solution. Additionally, pretreated membranes or single use only connectors also may be provided.

It is evident that the kit and system of this invention is easy to use and extremely reliable. Small amounts (micrograms) of pure enzymes (or other reactants) can be used to obtain reproducible results. There is no need to buy, store, or maintain fresh any more enzyme than the researcher or laboratory actually needs for use. The performance of the reactant, e.g., enzyme, in each different kit is carefully determined prior to packaging.

The kit may also include a substrate vial 359 (FIG. 22), a standard against which the enzyme may be checked, and reaction patterns in the form, for example, of HPLC or CZE profiles. A typical substrate vial is one with lyophilized reaction products which can be compared to the researcher's own runs. For example, a substrate vial for neuraminidase would contain lyophilized glycopeptides from tryptic digestion of reduced and alkylated human transferrin. Deionized water is added and the resulting solution is run through HPLC and/or CZE to obtain standard profiles for the researches to compare to his/her own test runs. The user reproduces the data prior to application to the user's "real" target sample to assure that he/she understands the procedures. It should be understood that the cross check standard (substrate vial) may be included in a fourth pouch sub-area (shown in FIG. 22) as pouch area 343.

Figure 23:
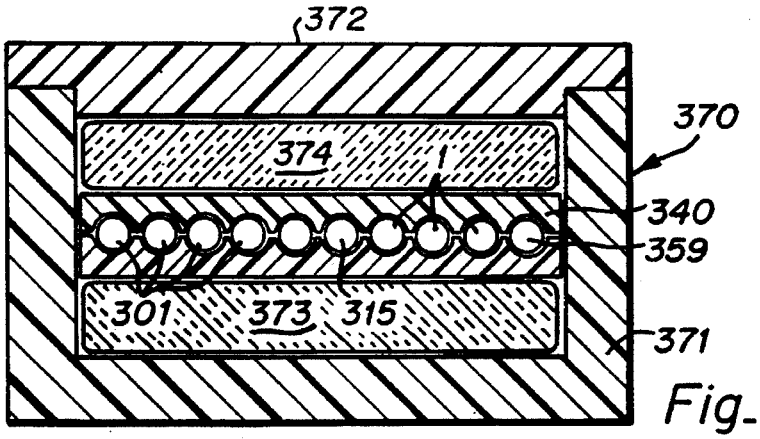
FIG. 23 is a section view through a refrigerated packaging system utilizing the enzyme kit of this invention.

FIG. 23 shows in section view a refrigerated packaging system 370 of this invention comprising a styrofoam box 371 and mating lid 372, an enzyme microtube pouch or box 340 containing a plurality of enzyme microtube assemblies, microtubes, connectors (not shown) and receiving microtubes 315, e.g., and an optional substrate microtube 400, and one or more refrigerant blocks 373, 374, such as a freezable gel, commercially available under the trademark "Blue Ice." This type of package is sealable and shippable in conventional outer packaging, such as sealable mylar or other plastic pouches.

The system (kit) with its reagent-coated vials, connectors, empty vials and optional substrate vial, is useful in a wide variety of applications. These include protein, glycoprotein and glycolipid analyses. Another major field of use is providing freeze-dried proteases coated on the inner walls of the enzyme vials for screening assessment of bio-related, physiologically-active substances, and in sequence analysis of proteins or peptides. In the latter case, the proteases provided by this invention can be used to fragment the proteins to peptides for peptide mapping, and for amino acid sequence determination. The invention simplifies these procedures to the point of where they can become routine. All the users need to do is add the protein solution (307 in FIG. 21) to the microtube and incubate it for a desired duration. The results will always be consistent as the enzyme activity rate is controlled and quantitatively precise.

Still another important field of use is that of an enzyme kit for analysis of sugar chain composition of complex carbohydrates and glycoproteins. For example, the glycopeptide and peptide mixture can be digested with neuraminidase for identification of the glycopeptide, and further digested for the structure determination.

In addition to containing one or more enzyme vials, the connector 313, the receiving vial 315, the substrate microtube 400, the standard sample analyses data (e.g., graphs), and detailed instructions, the kit of this invention can also include a buffer in the form of a tablet or ampoule of solution as a solvent for HPLC or CZE analysis or assay. A pre-prepared HPLC column and/or a fused silica capillary for electrophoresis, along with standard sample analyses data and detailed use instructions may also be provided. A membrane which binds lectines may be provided for separation or collection of glycopeptides and carbohydrates.

Example A

This Example illustrates a method of coating a typical micro-centrifuge microtube with an enzyme, here Neuraminidase. The dimensions of microtube 302 (FIG. 21) are: 10.00 mm O.D.; 8.50 mm I.D.; outer length 38.08 mm; inner length (inner vertex to top lip) 37.33 mm; useful volume 500 μL (to bottom of membrane support). Neuraminidase (1 Unit) is dissolved in 100 mM citric acid-sodium citrate buffer (pH 5.8, 1 mL). 10 μL of this 10 m units solution of neuraminidase in citrate phosphate buffer (pH 5.6) is introduced in the vial, which is held in a vertical (upright) position. The solution is frozen in a freezer at −20° C. The frozen solution is then lyophilized at room temperature, and provided to the kit.

Example B, Tryptic Digestion Kit

This example shows use of the enzyme tube, kit and system for tryptic digestion. Each enzyme vial (9 vials are provided in the kit] contains a dry coating of 20 μg (100 units) of Trypsin and Tri-buffer. The cross-check substrate microtube contains a dry coating of 500 μg reduced and alkylated human transferrin (see Example 3, below). Ten receiving microcentrifuge microtubes and connectors are provided, along with instructions and chromatographic profiles of the tryptic peptides (breakdown products) from transferrin. The method of application is as follows:

I. Soluble proteins:

1. Dialyze the protein sample against distilled water or diluted buffer of pH 8 (e.g. Tris buffer, 50 mM or lower concentration is desirable).
2. Add 100 μL of the sample solution (containing ca. 0.5–1.0 mg of protein) to the enzyme vial. Gently rotate to dissolve the contents, the lyophilized enzyme already in the vial.
3. Incubate for 5 hr at 37° C.
4. Heat in a boiling water bath for 3 min to denature the enzyme.
5. Remove any particulate matter by centrifuging through the ultrafiltration microtube (connector and receiving tube) provided.
6. Make up the filtrate to 200 μL.
7. Apply an aliquot of the solution for analysis.

II. Lyophilized proteins:

1. For lyophilized proteins, add ca 0.5–1.0 mg of lyophilized protein to the enzyme vial. Add 100 μL distilled water. Degassing of the vial or gentle centrifugation of the vial helps thorough wetting of the substrate protein.
2. Follow the steps 3 through 7 as described above.

Example C, Transferrin Substrate Vial

To prepare a standard-check, transferrin substrate vial for tryptic digestion, the following procedure is used:

1. Transferrin (500 mg) is dissolved in 0.2M Tris-HCl buffer (pH 8.2, 5 ml).

2. 8M guanidine hydrochloride (in 0.2M Tris-HCl, pH 8.2, 5 mL) and 0.18M dithiothreitol (in 0.2M Tris-Hcl, pH 8.2, 5 mL) are added to the above, then stirred for 30 minutes at room temperature.
3. 0.18M iodoacetamide and 6M guanidine hydrochloride solution (15 mL) are added to the above, then placed in the dark at room temperature.
4. The above mixture is dialyzed against distilled water at 4° C. for 24 hours.
5. The mixture is lyophilized.
6. The lyophilized protein is dissolved in 0.2 M Tris-HCl buffer (pH 8.2, 25 mL containing 1 mM $CaCl_2$) and TPCK-trypsin in 5 mg (in 200 mL Tris-HCl buffer) is added to the dissolved protein. Enzyme reaction takes place.
7. The above solution is incubated for 24 hours at 37° C.
8. The solution is heated for 3 minutes at 100° C. to deactivate enzyme.
9. The solution is centrifuged. The supernatant of centrifuged solution is eluted with 20 mM sodium bicarbonate through a column (2.5 cm×90 cm) of Sephadex G-50 to collect fractions of glycopeptide only.
10. The fractions of glycopeptides are lyophilized.
11. The above lyophilized protein is weighted and dissolved in water. The solution is poured into microtubes in the quantity of 200 μg each. This is the "substrate for neuraminidase".
12. The substrate is lyophilized in the substrated tube, and provided to the kit.

Example D, Activity Test—Neuraminidase on Transferrin

To test the activity of neuraminidase on the transferrin substrate, the following procedure is used:

1. The lyophilized substrate is dissolved in 200 μL water.
2. The 100 μL of substrate solution is added to the neuraminidase enzyme tube. An enzyme reaction takes place.
3. The reaction mixture is incubated for 5 hours at 37° C.
4. The reaction mixture is heated for 3 minutes at 100° C. and filtered through 0.4 μm filter.
5. The enzyme activity is evaluated by HPLC under the following conditions:
   Column: Cosmosil 5C18-AR (Nakalai Tesque)
   Mobile Phase: A>300 mM Boric Acid-triethylamine buffer (pH 7.0) containing acetonitrile (10%). B>300 mM Boric Acid-triethylamine buffer (ph 7.0) containing acetonitrile (30%).
   Flow rate: 1.0 ml/min. Gradient elution from eluent A> to eluent B> for 60 minutes.
   Detection: UV 220 nM.

As shown by comparing FIG. 18*a* and FIG. 18*b*, disappearance of the peak at around 26 min indicated that the peak was due to sialic acid containing glycopeptide. This is highly specific and quite characteristic, evidencing a good result.

Although the present invention has been described and illustrated in detail, it should be understood that various modifications within the scope of this invention can be made by one of ordinary skill in the art without departing from the spirit thereof. For example, the two tube adaptor may be made integral. In this embodiment, the universal adaptor shown in FIGS. 19 and 20 will include a single thick walled centrifuge tube, internally machined part way down the bore from the mouth to provide a shoulder and the internal dimensions described above. A hole through the bottom of the tube to allow air to escape is optional as ribs 120*b* permit escape of air and prevent air locking upon removal of the assembly 100. Further, the connector may include a pretreated membrane having predetermined amounts of reagent deposited thereon for performing diagnostic tests and other reactions which may require precise amounts of reagent. We therefore wish our invention to be defined by the scope of the appended claims in view of the specification as broadly as the prior art will permit.

What is claimed is:

1. A dual invertible microtube and connector assembly for transfer and treatment of micro solutions and centrifugation comprising in operative combination:

a) a first source microtube having a first open end and terminating in a second, tapered, permanently closed end, said first microtube adapted to contain a micro solution sample therein for treatment by inversion;

b) a second target microtube having substantially the same shape as said first microtube and having a first open end and terminating in a second, tapered, permanently closed end;

c) each of said microtubes includes adjacent to its open end:
   i) threads disposed along a first peripheral wall surface; and
   ii) a smooth, cylindrical second peripheral wall surface;

d) a connector assembly for connecting the open end of said first microtube to the open end of said second microtube, said connector assembly having a first generally cylindrical connector end having a smooth inner peripheral wall surface for slip fit connection about an outer peripheral wall of the open end of either of said first or second microtubes, and a second threaded connector end for threaded engagement with the threaded open end of the other one of said first or second microtubes;

e) a generally tubular membrane support having an outer peripheral wall, an inner peripheral wall and a generally flat foraminous membrane support surface disposed within said inner peripheral wall, said inner peripheral wall and said membrane foraminous support defining a central cavity for insertion within the open end of the microtube having said first connector end slip-fitted thereover;

f) a single means for securing a membrane to said foraminous surface of said membrane support in a manner to provide a liquid tight seal between the periphery of said membrane support and said membrane;

g) said membrane support in combination with said securing means retaining said membrane at a recessed distance within the open end of either of said first or second microtubes for filtering and applying a predetermined treatment to said sample solution while passing said sample solution from said first source microtube into said second target microtube by inversion of said first source microtube containing said sample solution to be filtered over said second target microtube; and h) said dual invertible microtube and connector assembly are adapted for inversion for unvented treatment of said sample solution, and for direct centrifugation of treated samples retained in said microtubes.

2. A dual microtube and connector assembly for micro solution samples as in claim 1 wherein said membrane support includes threads along an outer peripheral wall thereof for threaded engagement with said threads of either said first or second microtubes.

3. A dual microtube and connector assembly for micro solution samples as in claim 2 wherein said securing means for said membrane is a stopper member in the shape of a ring having an outer surface configuration adapted for snap fit insertion within said central cavity of said member support.

4. A dual microtube and connector assembly for micro solution samples as in claim 3 wherein said membrane is an ultrafiltration membrane having an average pore size of about 0.45 μm.

5. A dual invertible microtube and connector assembly for transfer and treatment of micro solutions and centrifugation comprising in operative combination:

a) a first, source microtube having a first open end and terminating in a second, tapered, permanently closed end, said first microtube adapted to contain a micro solution sample therein;

b) a second, target microtube having substantially the same shape as said first microtube and having a first open end and terminating in a second, tapered, permanently closed end;

c) each of said microtubes includes adjacent to its open end:

i) threads disposed along a first peripheral wall surface; and ii) a smooth, cylindrical second peripheral wall surface;

d) a connector assembly for connecting the open end of said first microtube to the open end of said second microtube, said assembly includes means for retaining a membrane at a recessed distance within the open end of said second microtube for filtering and applying a predetermined treatment to said micro solution sample while passing said micro solution sample from said first source microtube into said second target microtube by inversion of said first source microtube containing said sample solution to be filtered over said second target microtube, and said connector assembly includes:

i) an outer sleeve portion having an inner wall with a first threaded connector portion thereof for engaging the threaded open end of said first microtube, and a second connector portion of said wall having a smooth surface to slip over the threads of said second microtube end;

ii) an inner tubular membrane support having a first end integrally attached to said outer sleeve inner wall and a second free end sized for fitted insertion within the open end of said second microtube, said second end of said inner tubular membrane support includes a generally flat foramenous surface for receiving said membrane;

iii) a means for securing said membrane to said foramenous surface of said membrane support, and for liquid tight sealing between a periphery of said membrane support and said membrane and to substantially eliminate retention of fluid in said connector and said first microtube; and e) said dual invertible microtube and connector assembly are adapted for inversion for unvented treatment of said sample solution and for direct centrifugation of treated samples retained in said microtubes.

6. A dual microtube and connector assembly for micro solution samples as in claim 5 wherein:

a) said securing means for said membrane includes a generally tubular stopper member adapted for fitted insertion within said membrane support and having a bottom end wall coaligned with an upraised perimeter rib member provided to said foramenous surface of said membrane support for pinning said membrane to said membrane support.

7. A dual microtube and connector assembly for micro solution samples as in claim 6 wherein said outer surface portions of said first and second microtubes and said outer sleeve of said connector member are knurled.

8. A dual microtube and connector assembly for micro solution samples as in claim 7 which includes a membrane.

9. A dual microtube and connector assembly for micro solution samples as in claim 8 wherein said membrane is an ultrafiltration membrane having an average pore size of about 0.45 μm.

10. A dual microtube and connector assembly for micro solution samples as in claim 9 wherein said ultrafiltration membrane includes a component for treating said solution during passage therethrough.

11. A dual invertible microtube and connector assembly for transfer and treatment of micro solutions and centrifugation comprising in operative combination:

a) a first source microtube having a first open end and terminating in a second, tapered, permanently closed end, said first microtube adapted to contain a micro solution sample therein for treatment by inversion;

b) a second target microtube having substantially the same shape as said first microtube and having a first open end and terminating in a second, tapered, permanently closed end;

c) each of said microtubes includes adjacent to its open end:

i) threads disposed along a first peripheral wall surface; and ii) a smooth, cylindrical second peripheral wall surface;

d) a connector assembly for connecting the open end of said first microtube to the open end of said second microtube;

e) said connector assembly including means for retaining a membrane at a recessed distance within the open end of said second microtube for filtering and applying a predetermined treatment to said micro solution sample while passing said micro solution sample from said first source microtube into said second target microtube by inversion of said first source microtube containing said microsolution sample to be filtered over said second target microtube, and said connector assembly includes:

i) an outer sleeve portion having an inner wall with a first threaded connector portion thereof for engaging the threaded open end of said first microtube, and a second connector portion of said wall having a smooth surface to slip over the threads of said second microtube end;

ii) an inner tubular membrane support having a first end integrally attached to said outer sleeve inner wall and a second free end sized for fitted insertion within the open end of said second microtube, said second end of said inner tubular membrane support includes a generally flat foraminous surface for receiving said membrane; and iii) means for securing said membrane to said foraminous surface of said membrane support and for liquid tight sealing between a periphery of said membrane support and said membrane and to substantially eliminate retention of fluid in said connector and said first microtube;

f) a tubular adapter receivingly engaging at least said connector assembly for properly positioning and supporting said dual microtube and connector assembly within a centrifuge rotor when said first and second microtubes are connected by said connector means; and g) said dual invertible microtube and connector assembly are adapted for inversion for unvented treatment of said sample solution and for direct centrifugation of treated samples retained in said microtubes.

12. A dual microtube and connector assembly for treatment of micro solution samples as in claim 11 which includes an ultrafiltration membrane having an average pore size of about 0.45 μm.

13. A dual microtube and connector assembly for treatment of micro solution samples as in claim 12 wherein said ultrafiltration membrane includes a component for treating said solution during passage therethrough.

14. A dual microtube and connector assembly for treatment of micro solution samples as in claim 11 wherein said tubular adapter comprises in operative combination:

a) a first outer centrifuge adapter tube having slip-fit therewithin a second, shorter inner adapter tube;

b) said outer tube having an inside diameter sized to receive said connector means in slip-fit engagement;

c) said inner tube having an inside diameter sized to receive the exterior of said second microtube and to provide a shoulder for receiving said connector means in abutment thereagainst;

d) said inner tube having an axial length to support said container with its closed end spaced from the bottom of said inner tube; and e) said adapter combination permitting proper positioning and support of said dual microtube and connector assembly within a centrifuge rotor.

15. A universal adapter assembly as in claim 14 wherein:

a) a hole is provided in at least one of said adapter tubes to permit air to escape upon assembly thereof.

16. A connector assembly for connecting the threaded open ends of a pair of substantially identical, generally tubular microtubes in a connection-type invertible treatment system for micro solutions wherein a sample solution placed in a first microtube is passed through a membrane by inversion of the microtube containing the sample solution to be filtered over a second microtube with the treated sample collected in the second microtube with a minimum of solution loss, said connector comprising in operative combination:

a) an outer sleeve portion having a first threaded connector end for engaging the threaded open end of said first microtube and a second connector end sized for slip fit engagement with the open end of said second microtube;

b) means for retaining a membrane at a recessed distance within the open end of said second container and which includes:

i) an inner tubular membrane support having a first end integrally attached to said outer sleeve member adjacent said outer sleeve first threaded end and a second free end disposed sized for insertion within the open end of said second microtube;

ii) said second end of said inner tubular membrane support having a generally flat foraminous surface for receiving a membrane;

c) means for securing said membrane to said foraminous membrane support, and for liquid tight sealing between a periphery of said membrane support and said membrane and to substantially eliminate retention of fluid in said connector and said first container; and d) said first and said second microtubes and said connector providing an invertible dual microtube and connector assembly adapted for inversion for unvented treatment of of a sample solution and for direct centrifugation of treated samples retained in said microtubes.

17. A microsolution test kit comprising in operative combination:

a) a plurality of microtubes and at least one connector to permit formation of a dual invertible microtube and connector assembly for transfer and treatment of micro solutions and centrifugation as in claim 1;

b) a predetermined quantity of a known reagent coated on at least a portion of the inner wall surface of at least one of said first and said second microtubes to provide at least one micro solution reaction microtube;

c) a filter member disposable in said connector for filtering and/or applying a predetermined treatment to a sample solution while passing said sample solution from laid source microtube to said target microtube by inversion of said source microtube containing said sample solution to be treated over said second target microtube;

d) said reagent providing, upon introduction of a preselected reactant solution into the microtube containing said reagent, in situ delivery without meniscus errors of quantitatively correct amount of a required reagent for precise control of a reaction therewith; and e) a container having therein a plurality of said cooperating micro solution reaction microtubes, at least one connector assembly and at least one said filter member, together forming a test kit to provide at least one dual invertible microtube and connector assembly adapted for inversion for unvented treatment of said sample solution and for direct centrifugation of treated samples retained in said microtubes.

18. A microsolution test kit as in claim 17 wherein:

a) said reagent is selected from a compound, composition, mixture or element.

19. A microsolution test kit as in claim 18 wherein:

a) said reagent is a lyophilized material.

20. A microsolution test kit as in claim 19 wherein:

a) said reagent comprises an enzyme.

21. A microsolution test kit as in claim 20 wherein:

a) said enzyme is neuraminidase.

22. A microsolution test kit as in claim 17 which includes:

a) a filter member disposed in said connector means to filter reaction solution passing from said micro solution reaction microtube to a connected, receiving target microtube upon inversion.

23. A microsolution test kit as in claim 17 which includes:

a) at least one aliquot of a buffer.

24. A microsolution test kit as in claim 23 wherein:

a) said buffer is in tablet form or an ampoule of solution.

25. A microsolution test kit as in claim 17 which includes:

a) at least one chart providing to the user of the kit a typical analyses, and the expected result of a preselected reaction product related to the associated reaction of a sample solution and the reagent in said micro solution reaction microtube.

26. A reaction kit as in claim 21 which includes:

a) at least one chart providing to the user of the kit a typical analyses, and the expected result, of a preselected reaction product related to the associated reaction of a sample solution and the reagent in said micro solution reaction microtube.

27. A microsolution test kit comprising in operative combination:

a) a plurality of microtubes and at least one connector to permit formation of a double microtube and connector assembly as in claim 5;

b) a predetermined quantity of a known reagent coated on at least a portion of the inner wall surface of at least one of said first and said second microtubes to provide at least one micro solution reaction microtube;

c) a filter member disposable in said connector for filtering and/or applying a predetermined treatment to a sample solution while passing said sample solution from said source microtube to said target microtube;

d) said reagent providing, upon introduction of a preselected reactant solution into the microtube containing said reagent, in situ delivery of quantitatively correct amount of a required reagent for precise control of a reaction therewith; and e) a container having therein a plurality of said cooperating micro solution reaction microtubes, at least one connector assembly and at least one said filter member, together forming a test kit.

28. A microsolution test kit as in claim 27 wherein:

a) said reagent is selected from a compound, composition, mixture or element.

29. A microsolution test kit as in claim 28 wherein:

a) said reagent is a lyophilized material.

30. A microsolution test kit as in claim 29 wherein:

a) said reagent comprises an enzyme.

31. A microsolution ion test kit as in claim 30 wherein:

a) said enzyme is neuraminidase.

32. A microsolution test kit as in claim 27 which includes:

a) a filter member disposed in said connector to filter reaction solution passing from said micro solution reaction microtube to a connected, receiving target microtube upon inversion.

33. A microsolution test kit as in claim 27 which includes:

a) at least one aliquot of a buffer.

34. A microsolution test kit as in claim 33 wherein:

said buffer is in tablet form or an ampoule of solution.

35. A microsolution test kit as in claim 27 which includes:

a) at least one chart providing to the user of the kit a typical analyses, and the expected result of a preselected reaction product related to the associated reaction of a sample solution and the reagent in said micro solution reaction microtube.

36. A reaction kit as in claim 31 which includes:

a) at least one chart providing to the user of the kit a typical analyses, and the expected result, of a preselected reaction product related to the associated reaction of a sample solution and the reagent in said micro solution reaction microtube.

37. A filter member as in claim 17 wherein said filter member is for single use and has deposited thereon a color indicator reagent which changes color when a fluid is passed therethrough.

38. A connector as in claim 17 wherein said connector is for single use only and having disposed therein a single use filter member, said filter member having deposited thereon a color indicator reagent which changes color when a fluid is passed through said single use filter member.

39. A filter member as in claim 27 wherein said filter member is for single use and has deposited thereon a color indicator reagent which changes color when a fluid is passed therethrough.

40. A connector as in claim 27 wherein said connector is for single use only and having disposed therein a single use filter member, said filter member having deposited thereon a color indicator reagent which changes color when a fluid is passed through said single use filter member.

* * * * *